US010625970B2

(12) United States Patent
Yamamoto et al.

(10) Patent No.: US 10,625,970 B2
(45) Date of Patent: Apr. 21, 2020

(54) IMAGE FORMING APPARATUS, METHOD FOR CONTROLLING THE SAME, AND NON-TRANSITORY COMPUTER-READABLE STORAGE MEDIUM

(71) Applicant: CANON KABUSHIKI KAISHA, Tokyo (JP)

(72) Inventors: Satoru Yamamoto, Noda (JP); Koji Yumoto, Toride (JP); Takashi Yokoya, Yoshikawa (JP); Akihiro Kawakita, Abiko (JP); Akinobu Nishikata, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/210,548

(22) Filed: Dec. 5, 2018

(65) Prior Publication Data

US 2019/0168982 A1 Jun. 6, 2019

(30) Foreign Application Priority Data

Dec. 6, 2017 (JP) ..... 2017-234093

(51) Int. Cl.

| | |
|---|---|
| ***B65H 29/60*** | (2006.01) |
| ***B65H 5/06*** | (2006.01) |
| ***B65H 31/24*** | (2006.01) |
| ***B65H 9/00*** | (2006.01) |
| ***B65H 7/04*** | (2006.01) |
| ***B65H 3/44*** | (2006.01) |

(Continued)

(52) U.S. Cl.

CPC ..... *B65H 29/60* (2013.01); *B65H 3/44* (2013.01); *B65H 5/062* (2013.01); *B65H 7/04* (2013.01); *B65H 7/20* (2013.01); *B65H 9/006* (2013.01); *B65H 31/24* (2013.01); *B65H 39/042* (2013.01); *B65H 2511/414* (2013.01); *B65H 2511/515* (2013.01); *B65H 2801/06* (2013.01)

(58) Field of Classification Search

CPC ... B65H 3/44; B65H 7/04; B65H 7/20; B65H 29/60; B65H 5/062; B65H 9/006; B65H 31/24; B65H 39/042; B65H 2511/414; B65H 2511/515; B65H 2801/06

USPC ..... 270/58.18

See application file for complete search history.

(56) References Cited

U.S. PATENT DOCUMENTS 6,751,426 B2 6/2004 Akiba et al.
8,038,139 B2 10/2011 Nishimura et al.

(Continued)

FOREIGN PATENT DOCUMENTS

JP 2003-221160 A 8/2003

*Primary Examiner* — Leslie A Nicholson, III
(74) *Attorney, Agent, or Firm* — Venable LLP

(57) ABSTRACT

An image forming apparatus includes a controller configured to start feeding a sheet from a feeding unit without confirming a presence or absence of an insert sheet to be inserted before the sheet when an amount of insert sheets stacked on a stacking tray as a feed source is higher than a predetermined amount. In a case in which the amount of the insert sheets on the stacking tray is lower than the predetermined amount, the controller starts feeding a sheet from the feeding unit without confirming a presence or absence of the insert sheet when another stacking tray on which an amount of insert sheets is higher than the predetermined amount is present, and the controller starts feeding the sheet from the feeding unit after confirming the presence or absence of the insert sheet when the other stacking tray is absent.

5 Claims, 15 Drawing Sheets

(51) Int. Cl.
*B65H 7/20* (2006.01)
*B65H 39/042* (2006.01)

(56) References Cited

U.S. PATENT DOCUMENTS

| | | | | |
|---|---|---|---|---|
| 8,157,255 | B2 * | 4/2012 | Nishimura | B42C 1/12 270/58.23 |
| 2018/0348689 | A1 * | 12/2018 | Ando | G03G 15/655 |
| 2019/0049892 | A1 | 2/2019 | Yokoya et al. | |

* cited by examiner

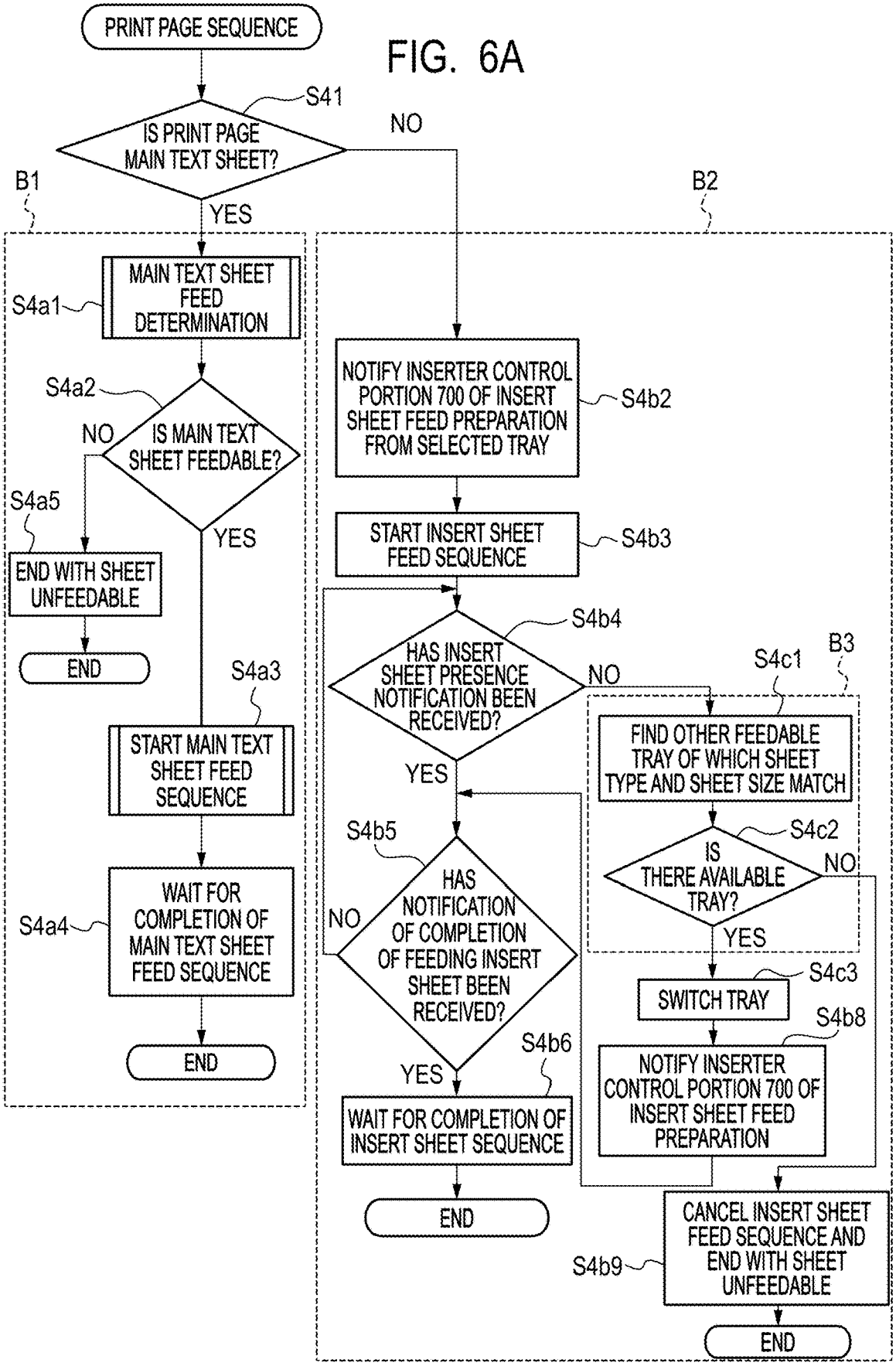
FIG. 6A
PRINT PAGE SEQUENCE
S41
IS PRINT PAGE MAIN TEXT SHEET?
NO
YES
B1
B2
S4a1
MAIN TEXT SHEET FEED DETERMINATION
S4a2
IS MAIN TEXT SHEET FEEDABLE?
NO
YES
S4a5
END WITH SHEET UNFEEDABLE
END
S4a3
START MAIN TEXT SHEET FEED SEQUENCE
S4a4
WAIT FOR COMPLETION OF MAIN TEXT SHEET FEED SEQUENCE
END
NOTIFY INSERTER CONTROL PORTION 700 OF INSERT SHEET FEED PREPARATION FROM SELECTED TRAY
S4b2
START INSERT SHEET FEED SEQUENCE
S4b3
S4b4
HAS INSERT SHEET PRESENCE NOTIFICATION BEEN RECEIVED?
NO
YES
S4c1
B3
FIND OTHER FEEDABLE TRAY OF WHICH SHEET TYPE AND SHEET SIZE MATCH
S4c2
IS THERE AVAILABLE TRAY?
NO
YES
S4b5
HAS NOTIFICATION OF COMPLETION OF FEEDING INSERT SHEET BEEN RECEIVED?
NO
YES
S4c3
SWITCH TRAY
S4b8
NOTIFY INSERTER CONTROL PORTION 700 OF INSERT SHEET FEED PREPARATION
S4b6
WAIT FOR COMPLETION OF INSERT SHEET SEQUENCE
END
S4b9
CANCEL INSERT SHEET FEED SEQUENCE AND END WITH SHEET UNFEEDABLE
END

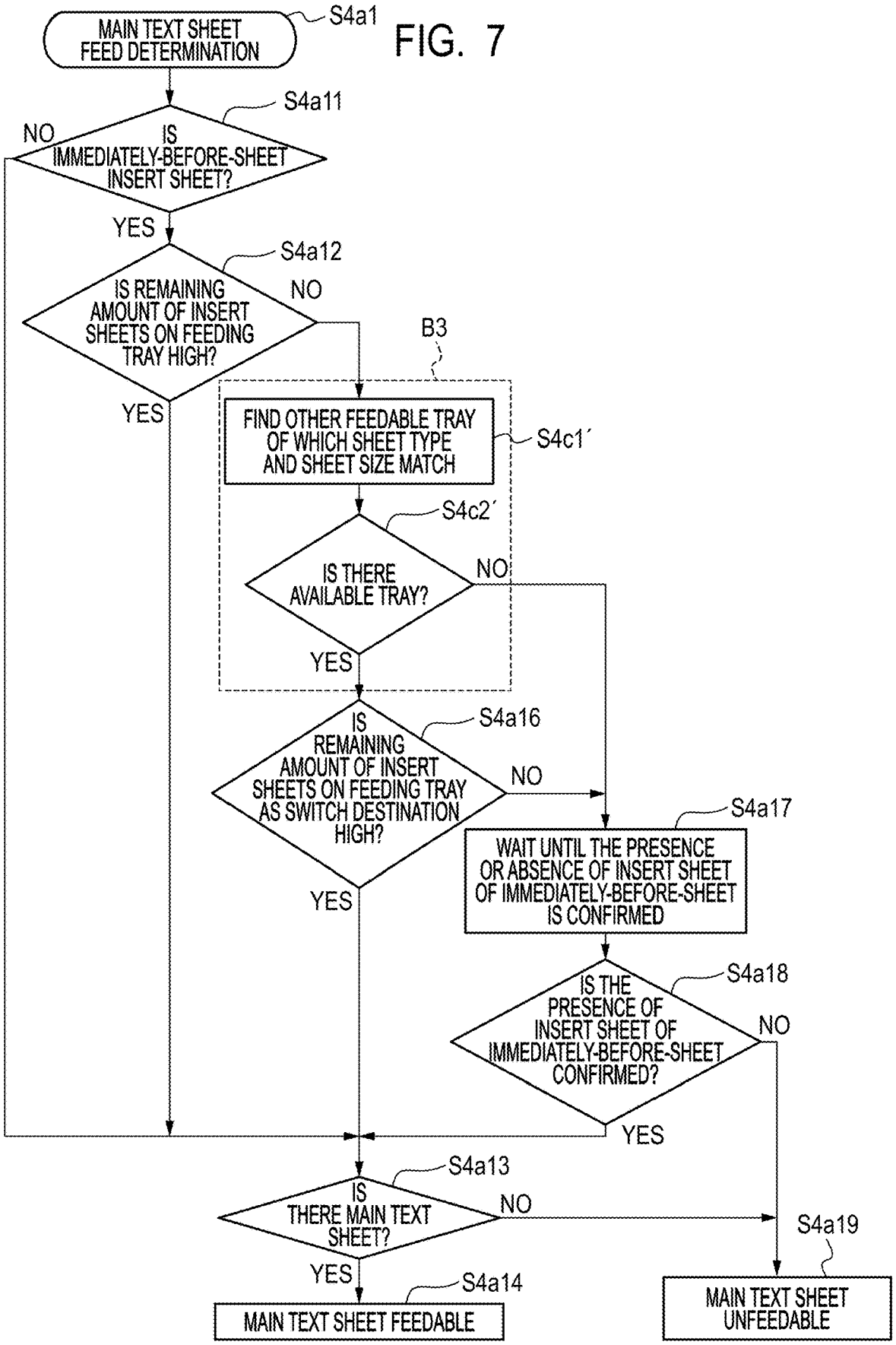
FIG. 7
MAIN TEXT SHEET FEED DETERMINATION
S4a1
IS IMMEDIATELY-BEFORE-SHEET INSERT SHEET?
S4a11
NO
YES
IS REMAINING AMOUNT OF INSERT SHEETS ON FEEDING TRAY HIGH?
S4a12
NO
YES
B3
FIND OTHER FEEDABLE TRAY OF WHICH SHEET TYPE AND SHEET SIZE MATCH
S4c1′
IS THERE AVAILABLE TRAY?
S4c2′
NO
YES
IS REMAINING AMOUNT OF INSERT SHEETS ON FEEDING TRAY AS SWITCH DESTINATION HIGH?
S4a16
NO
YES
WAIT UNTIL THE PRESENCE OR ABSENCE OF INSERT SHEET OF IMMEDIATELY-BEFORE-SHEET IS CONFIRMED
S4a17
IS THE PRESENCE OF INSERT SHEET OF IMMEDIATELY-BEFORE-SHEET CONFIRMED?
S4a18
NO
YES
IS THERE MAIN TEXT SHEET?
S4a13
NO
YES
MAIN TEXT SHEET FEEDABLE
S4a14
MAIN TEXT SHEET UNFEEDABLE
S4a19

| FIG. 9A |
| --- |
| FIG. 9B |

| FIG. 10A |
| --- |
| FIG. 10B |

IMAGE FORMING APPARATUS, METHOD FOR CONTROLLING THE SAME, AND NON-TRANSITORY COMPUTER-READABLE STORAGE MEDIUM

BACKGROUND OF THE INVENTION

Field of the Invention

The present invention relates to an image forming apparatus having an insert sheet function, a method for controlling the image forming apparatus, and a non-transitory computer-readable storage medium.

Description of the Related Art

There has been an image forming system including a feeding portion for feeding transfer sheets to be subjected to image formation and an inserter for stacking insert sheets to be inserted between transfer sheets. In such an image forming system, feeding control in a job for feeding an insert sheet from an inserter and next feeding a transfer sheet from a sheet feeding portion includes the following two operations.

A first operation is one in which the feeding of a transfer sheet is confirmed without waiting the confirmation of the presence of an insert sheet preceding the transfer sheet, and the transfer sheet is pulled into a conveyance path from a sheet feeding portion. Hereafter, such feeding control for a transfer sheet will be called an "operation without confirming the presence or absence of an insert sheet". In the "operation without confirming the presence or absence of an insert sheet", for example, if the proceeding insert sheet suddenly becomes absent, the transfer sheet already pulled into the conveyance path cannot be discharged and remains in the apparatus. This is because if the transfer sheet is forcibly discharged, a page order of a product becomes incorrect.

As a second operation to prevent this, there is an operation in which the feeding of a transfer sheet is started after a wait for the confirmation of the presence of an insert sheet preceding a transfer sheet. Hereafter, such feeding control for a transfer sheet will be called an "operation of confirming the presence or absence of an insert sheet". In the "operation of confirming the presence or absence of an insert sheet", a page order of a product caused by a sudden absence of an insert sheet can be prevented, whereas a lag between sheets increases because of a delay caused by waiting the presence or absence of the insert sheet to be confirmed, which significantly degrades productivity.

Hence, an image forming system is proposed that performs feeding control on a transfer sheet in the "operation without confirming the presence or absence of an insert sheet" when the number of loaded insert sheets is high, and performs feeding control on a transfer sheet in the "operation of confirming the presence or absence of an insert sheet" when the number of loaded insert sheets becomes low (Japanese Patent Application Laid-Open No. 2003-221160). This can prevent the discharge of an incomplete product due to the occurrence of a sudden absence of an insert sheet, while maintaining productivity.

The above technique of Japanese Patent Application Laid-Open No. 2003-221160 can improve productivity when the remaining amount of insert sheets in an inserter is large, but involves a problem in that the productivity decreases when a small or no remaining amount of the insert sheets is detected.

SUMMARY OF THE INVENTION

According to an embodiment, an image forming apparatus, comprises:

a feeding unit configured to feed a sheet;

an image forming unit configured to form an image on the sheet fed from the feeding unit;

a plurality of stacking trays on which insert sheets to be inserted between sheets are stacked;

an insert unit configured to feed an insert sheet stacked on a stacking tray of the plurality of stacking trays as a feed source and to convey the insert sheet;

detection units configured to detect amounts of insert sheets stacked on the plurality of stacking trays, respectively; and a controller configured to start feeding of a sheet from the feeding unit without confirming a presence or absence of an insert sheet to be inserted before the sheet in a case in which an amount of insert sheets stacked on the stacking tray as the feed source is higher than a predetermined amount, wherein the insert unit switches the feed source from the stacking tray to another stacking tray of the plurality of stacking trays in a case in which the insert sheets stacked on the stacking tray as the feed source become absent, and wherein in a case in which the amount of the insert sheets stacked on the stacking tray as the feed source is lower than the predetermined amount, the controller starts feeding of a sheet from the feeding unit without confirming a presence or absence of an insert sheet to be inserted before the sheet when another stacking tray on which an amount of insert sheets is higher than the predetermined amount is present, and the controller starts the feeding of the sheet from the feeding unit after confirming the presence or absence of the insert sheet to be inserted before the sheet when the other stacking tray is absent.

Further features of the present invention will become apparent from the following description of exemplary embodiments with reference to the attached drawings.

BRIEF DESCRIPTION OF THE DRAWINGS

FIG. 6A, FIG. 6B, and FIG. 6C are flowcharts of a print page sequence starting process.

FIG. 7 is a flowchart of a main text sheet feed determination process.

DESCRIPTION OF THE EMBODIMENTS

Figure 1:
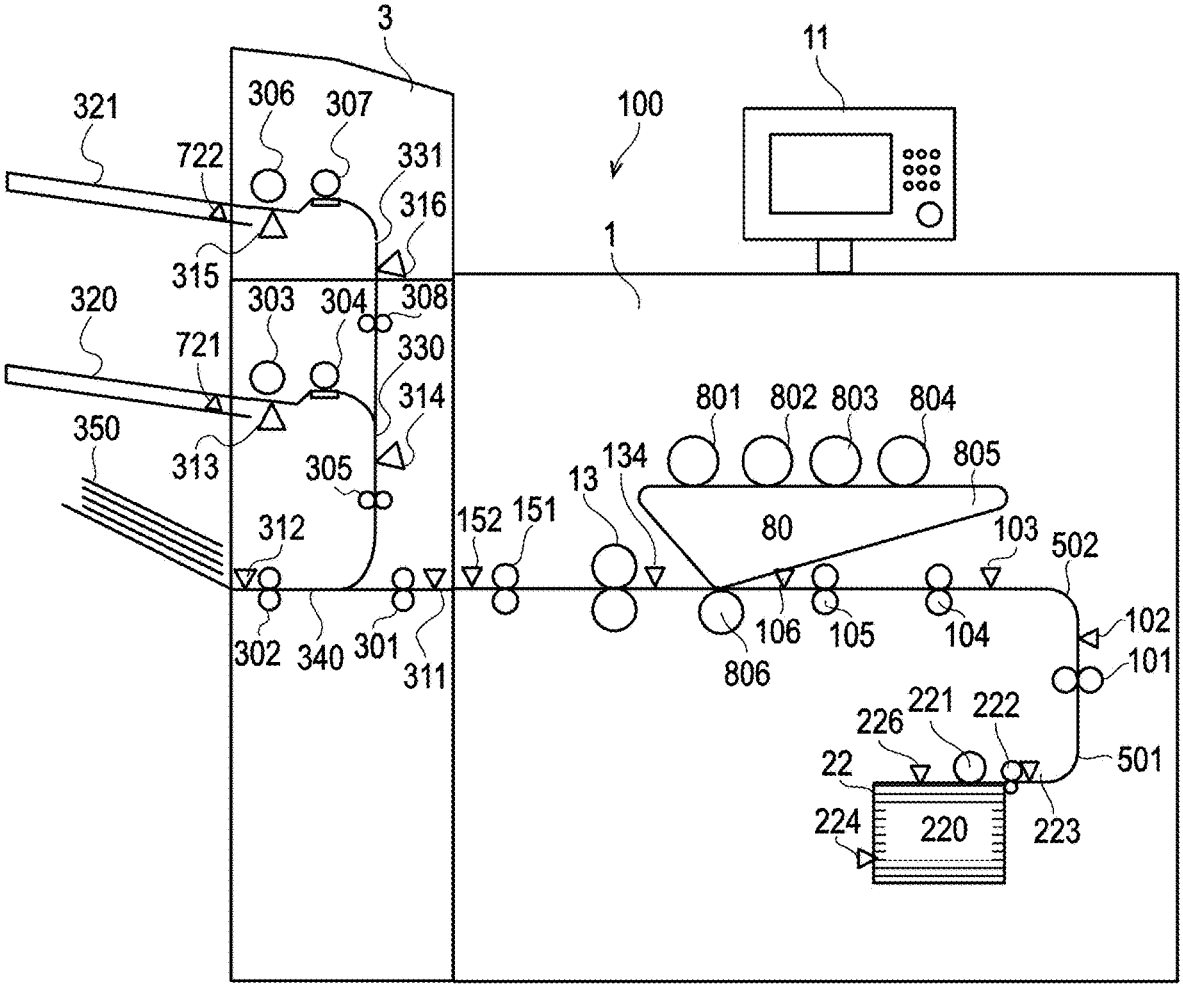
FIG. 1 is a diagram illustrating an example of an image forming system of the present embodiment.

FIG. 1 is a diagram illustrating an example of an image forming system 100, illustrating an embodiment of the present embodiment. The image forming system 100 includes an image forming apparatus 1 and an inserter 3.

<Image Forming Apparatus 1>

The image forming apparatus 1 includes a user interface (hereafter, referred to as a UI) 11, and a user uses the UI 11 to give instructions to perform printing such as copying. When the user gives the instructions to perform printing, the image forming apparatus 1 feeds transfer sheets one by one from a sheet feeding portion 22 that receives a plurality of transfer sheets. The transfer sheets are placed in a sheet stacker 220.

In the sheet stacker 220, a lifter motor (not illustrated) and sheet surface sensor 226 control the position of a transfer sheet forming a topmost surface so that a topmost sheet is brought into contact with a pickup roller 221. A sheet stacker remaining amount sensor 224 is an optical sensor configured to detect that the remaining amount of transfer sheets placed on the sheet stacker becomes small and is configured to determine that the remaining amount of the transfer sheets is large when a sensor light receiving portion is shielded from light by the transfer sheets, and to determine that the remaining amount of the transfer sheets is small when the sensor light receiving portion is not shielded.

The pickup roller 221 is configured to send the topmost sheet in the sheet stacker 220 to a feed roller 222. A feed roller 222 includes an upper roller configured to rotate in a sending direction and a lower roller configured to rotate in a returning direction, by which the transfer sheets are fed being separated one from another. A feeding sensor 223 is used to check whether the topmost sheet has successfully picked up with a predetermined timing, and if the sensor is not yet turned on even after a predetermined time elapses from the start of picking up the topmost sheet, the feeding operation is brought to a jam stop. The feeding operation is brought to a jam stop also if the sensor is not yet turned off by the passage of the trailing edge of a transfer sheet even after a predetermined time elapses (hereafter, referred to as a "residence jam").

A transfer sheet passed through the feed roller 222 is conveyed to a vertical path 501. The transfer sheet passed through a path sensor 102 by a vertical path roller 101 is guided by a horizontal path 502 to an image forming portion 80, where an image is transferred onto the transfer sheet, the image forming portion 80 including drums 801 to 804, an intermediate transfer member 805, and a secondary transfer portion 806.

In the image forming apparatus 1, the image of the image forming portion 80 and the transfer sheet in the horizontal path 502 is subjected to leading edge registration using a pre-registration sensor 103, a pre-registration roller 104, a registration roller 105, and a registration sensor 106. For the leading edge registration between the image and the transfer sheet, there is a widely-known configuration in which the registration roller 105 is driven based on signals synchronizing with image formation.

The image transferred onto the transfer sheet is fixed to the transfer sheet by passing the transfer sheet through a fixing portion 13 being pressed and heated. The transfer sheet with the image fixed thereto is conveyed to the inserter 3 by a discharge roller 151. Whether delivery to the inserter 3 is completed with a predetermined timing is checked by a discharge sensor 152, and if the transfer sheet still resides even after a predetermined time elapses, the conveyance is determined as a residence jam and stopped. Note that the image forming apparatus is not limited to that employing an electrophotographic process, and may be that performing image formation in another printing process such as an inkjet process.

<Inserter 3>

The transfer sheet onto which the image is transferred and fixed by the image forming apparatus 1 is passed through the discharge roller 151 and delivered to the inserter 3. The transfer sheet discharged from the image forming apparatus 1 enters the inserter 3 and is detected by an inserter inlet sensor 311 of the inserter 3. The detection drives an inlet roller 301, by which the transfer sheet is conveyed to a horizontal path 340. The transfer sheet is passed through a discharge roller 302 and then discharged to a discharge tray 350 of the inserter 3. An inserter discharge sensor 312 is a sensor configured to detect whether a transfer sheet is discharged to the discharge tray 350 normally. How to drive the transfer sheet subjected to the image formation by the image forming apparatus 1 was described above.

A driving system for conveying an insert sheet fed from a feeding tray of the inserter 3 will be described below. The inserter 3 includes a first feeding tray 320 as an insert sheet stacking portion stacked with insert sheets to be inserted between transfer sheets subjected to the image formation at the image forming apparatus 1 and configured to feed and convey the insert sheets. A first feed roller 303 conveys downstream a topmost sheet of the insert sheets stacked on the first feeding tray 320, and a first separation roller 304 reliably conveys only the topmost sheet to a first conveyance path 330. The insert sheet guided to the first conveyance path 330 is conveyed from a registration sensor 314 by a predetermined distance, and the insert sheet is once stopped with the leading edge of the insert sheet in a conveyance direction abutted against a registration roller 305 being stopped, forming a loop (hereafter, this will be called "wait for merging"). This corrects a skew feed of an insert sheet occurring in a feeding-conveying operation.

Then, in synchronization with a timing signal from the image forming apparatus 1, a first separation roller 304, a registration roller 305, and a discharge roller 302 are driven, by which the insert sheet is passed through a merging point of the first conveyance path 330 and the horizontal path 340 and discharged to the discharge tray 350.

The inserter 3 according to the present embodiment further includes a second feeding tray 321 and includes, as with the first feeding tray 320, a second feed roller 306 configured to feed an insert sheet from the second feeding tray 321, a second separation roller 307, and a second conveyance path 331. The inserter 3 also includes a feed sensor 316 and a feed roller 308. How to convey the insert sheet to the registration roller 305 is substantially the same as the first feeding tray 320 and thus not described. As seen from the above, the inserter 3 feeds the insert sheet from one of feed sources including a plurality of feeding trays (the first feeding tray 320 and the second feeding tray 321) and conveys the insert sheet for merging downstream of the image forming apparatus 1.

The first feeding tray 320 includes a first inserter sheet remaining amount sensor 721, and the second feeding tray 321 includes a second inserter sheet remaining amount sensor 722. The first inserter sheet remaining amount sensor 721 is capable of detecting whether the first feeding tray 320 is stacked with any sheets. The second inserter sheet remaining amount sensor 722 is capable of detecting whether the second feeding tray 321 is stacked with any sheets. The first inserter sheet remaining amount sensor 721 and the second inserter sheet remaining amount sensor 722 have the same configuration, and the first feeding tray 320 and the second feeding tray 321 have the same configuration. Hence, in cases where common functions are described, the first inserter sheet remaining amount sensor 721 and the second inserter sheet remaining amount sensor 722, and the first feeding tray 320 and the second feeding tray 321 will be simply referred to as an "inserter sheet remaining amount sensor" and a "feeding tray", respectively. The inserter sheet remaining amount sensor is capable of detecting that a remaining amount of sheets placed on the feeding tray has become small. The inserter sheet remaining amount sensor is, for example, an optical sensor and can determine that the remaining amount of the insert sheets is large when a sensor light receiving portion is shielded from light by the insert sheets, and can determine that the remaining amount of the insert sheets is small when the sensor light receiving portion is not shielded.

The image forming system 100 may be formed of one image forming apparatus by making the image forming apparatus 1 have the functions of the inserter 3.

Figure 2:
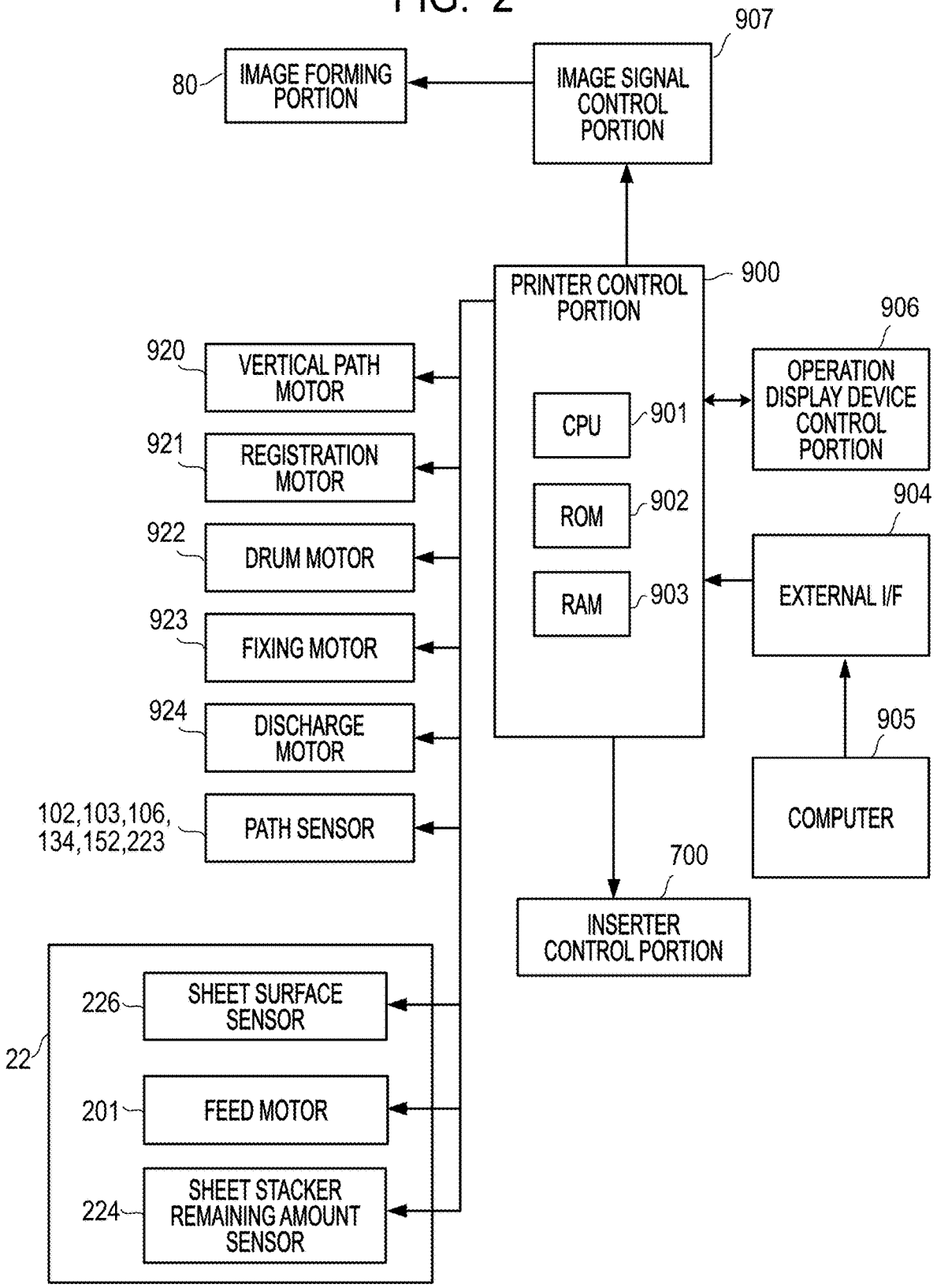
FIG. 2 is a diagram illustrating an example of the configuration of a controller included in the image forming system of the present embodiment.

FIG. 2 is a diagram illustrating an example of the configuration of a controller for governing overall control of the image forming system 100. As the configuration of the controller, the image forming system 100 includes a printer control portion 900. The printer control portion 900 comes built-in with a CPU 901, a ROM 902, and a RAM 903, and control programs stored in the ROM 902 are used to control an image signal control portion 907, an operation display device control portion 906, and the image forming apparatus 1 collectively. The RAM 903 is used to temporarily hold control data or as a working area for calculation processing associated with the control. The ROM 902 is formed of a flash ROM and capable of storing programs, various kinds of setting information, and the like.

The image signal control portion 907 is configured to perform various kinds of processing on a digital image signal input from a computer 905 via an exterior interface (external I/F) 904, convert this digital image signal into a video signal, and output the video signal to the image forming portion 80.

The operation display device control portion 906 is configured to control the UI 11 illustrated in FIG. 1 to exchange information with the printer control portion 900. The UI 11 includes a plurality of keys for setting various functions relating to image formation and a display portion for displaying information indicating a setting state. The UI 11 is configured to output a key signal corresponding to an operation of each key to the printer control portion 900 and to display information corresponding to a signal from the printer control portion 900 on the display portion.

Next, a principal sheet conveyance driving system of the image forming apparatus 1 relating to the description of the present embodiment will be described with reference to FIG. 1 and FIG. 2. The image forming apparatus 1 includes a feed motor 201 configured to drive the pickup roller 221, the feed roller 222, and a vertical path motor 920 configured to drive the vertical path roller 101, as a driving source from the feeding portion 22 to the vertical path 501. The feeding portion 22 includes the sheet stacker remaining amount sensor 224 configured to detect that the remaining amount of transfer sheets placed in the sheet stacker 220 becomes lower than a prescribed amount.

The image forming apparatus 1 includes the pre-registration roller 104 and a registration motor 921 that is configured to drive the registration roller 105, as a driving source from the horizontal path 502 to a transfer portion. The image forming apparatus 1 includes a drum motor 922, a fixing motor 923, and a discharge motor 924, as a driving source from the transfer portion to the discharge portion. The drum motor 922 is configured to drive the drums 801 to 804, the intermediate transfer member 805, and the secondary transfer portion 806 in the image forming portion 80. The fixing motor 923 is configured to drive the fixing portion 13. The discharge motor 924 is configured to drive the discharge roller 151.

The image forming apparatus 1 additionally includes path sensors 102, 103, 106, 134, 152, and 223 to detect the passage of a transfer sheet, and input signals from these path sensors are input to the printer control portion 900. A transfer sheet passed through the discharge roller 151 is delivered to the inserter 3 and controlled by an inserter control portion 700.

Figure 3:
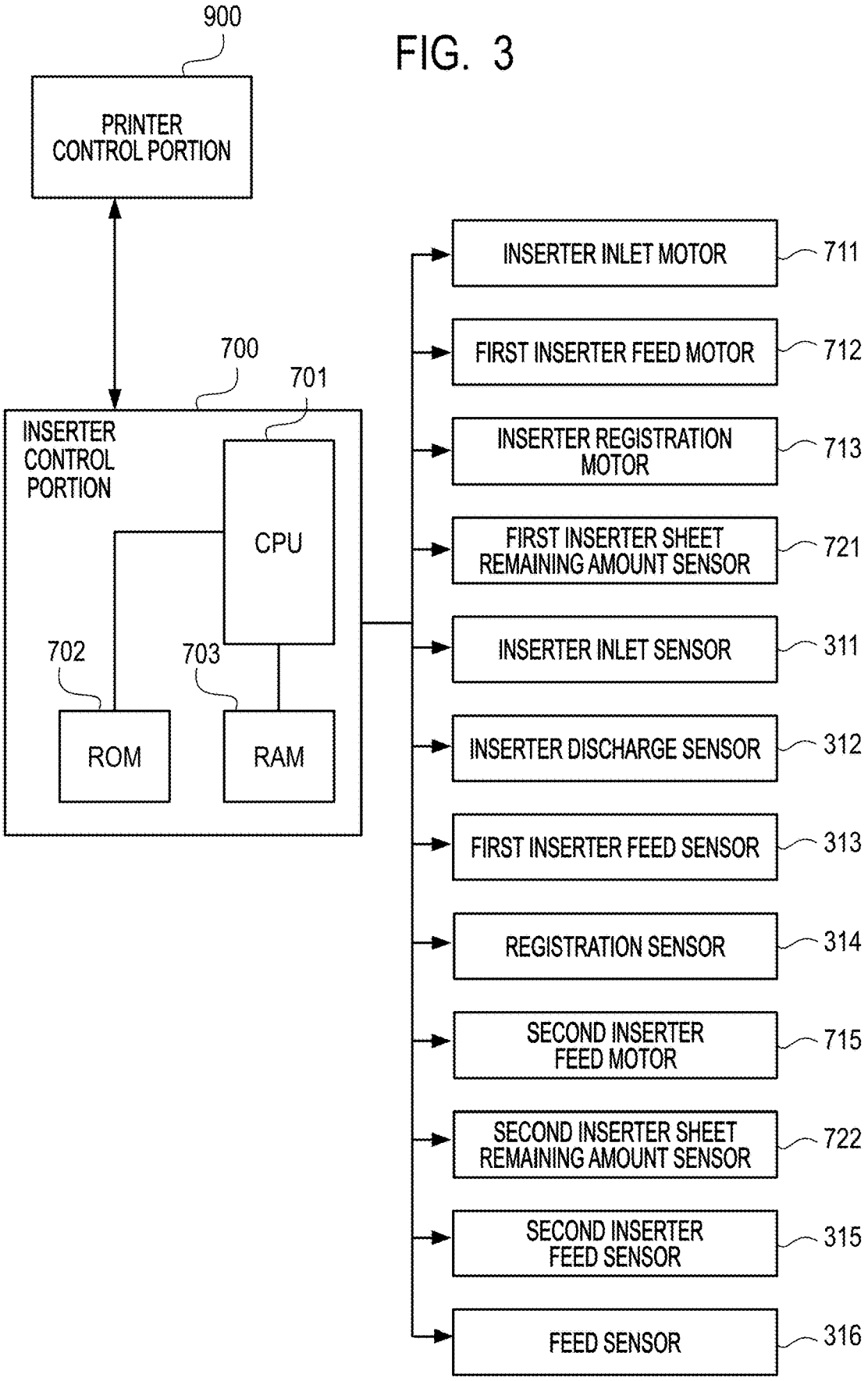
FIG. 3 is a diagram illustrating an example of the configuration of an inserter control portion.

FIG. 3 is a diagram illustrating an example of the configuration of the inserter control portion 700. The inserter control portion 700 comes built-in with a CPU 701, a ROM 702, and a RAM 703, and control programs stored in the ROM 702 are used to control the inserter 3. The RAM 703 is used to temporarily hold control data or as a working area for calculation processing associated with the control. The ROM 702 is formed of a flash ROM and capable of storing programs, various kinds of setting information, and the like.

Next, a principal sheet conveyance driving system of the inserter 3 will be described with reference to FIG. 1 and FIG. 3. The inserter 3 includes the inlet roller 301 and an inserter inlet motor 711 that is configured to drive the discharge roller 302, as a driving source for receiving a transfer sheet output from the image forming apparatus 1 and conveying the transfer sheet to the discharge tray 350.

The inserter 3 includes a first feed roller 303 configured to feed an insert sheet and a first inserter feed motor 712 configured to drive the first separation roller 304, as a driving source from the feeding from the inserter 3 up to the correction of a skew feed in the first conveyance path 330. The inserter 3 further includes the second feed roller 306 and a second inserter feed motor 715 that is configured to drive the second separation roller 307.

The inserter 3 also includes an inserter registration motor 713 configured to drive the registration roller 305, as a driving source from the correction of a skew feed of an insert sheet fed from the first feeding tray 320 up to the conveyance of the insert sheet to the merging point with the path from the image forming apparatus 1.

The inserter 3 includes the first inserter sheet remaining amount sensor 721, the inserter inlet sensor 311, the inserter discharge sensor 312, an inserter feed sensor 313, the second inserter sheet remaining amount sensor 722, a second inserter feed sensor 315, the registration sensor 314, and the feed sensor 316 to detect the passage of a sheet. Input signals from these sensors are input to the inserter control portion 700. In a case in which a plurality of insert sheets are set on the feeding tray, and then the insert sheets are continuously fed in a job, a previous insert sheet is subjected to a skew correction by the registration roller 305 in a stop state, then the conveyance of the previous insert sheet to the horizontal path 340 is started by instructions from the printer control portion 900, and a trailing edge of the previous insert sheet is passed through the first inserter sheet remaining amount sensor 721 or the second inserter sheet remaining amount sensor 722, and only thereafter the first inserter sheet remaining amount sensor 721 or the second inserter sheet remaining amount sensor 722 becomes able to detect the presence or absence of a next insert sheet on the first feeding tray 320 or the second feeding tray 321.

Figure 4A:
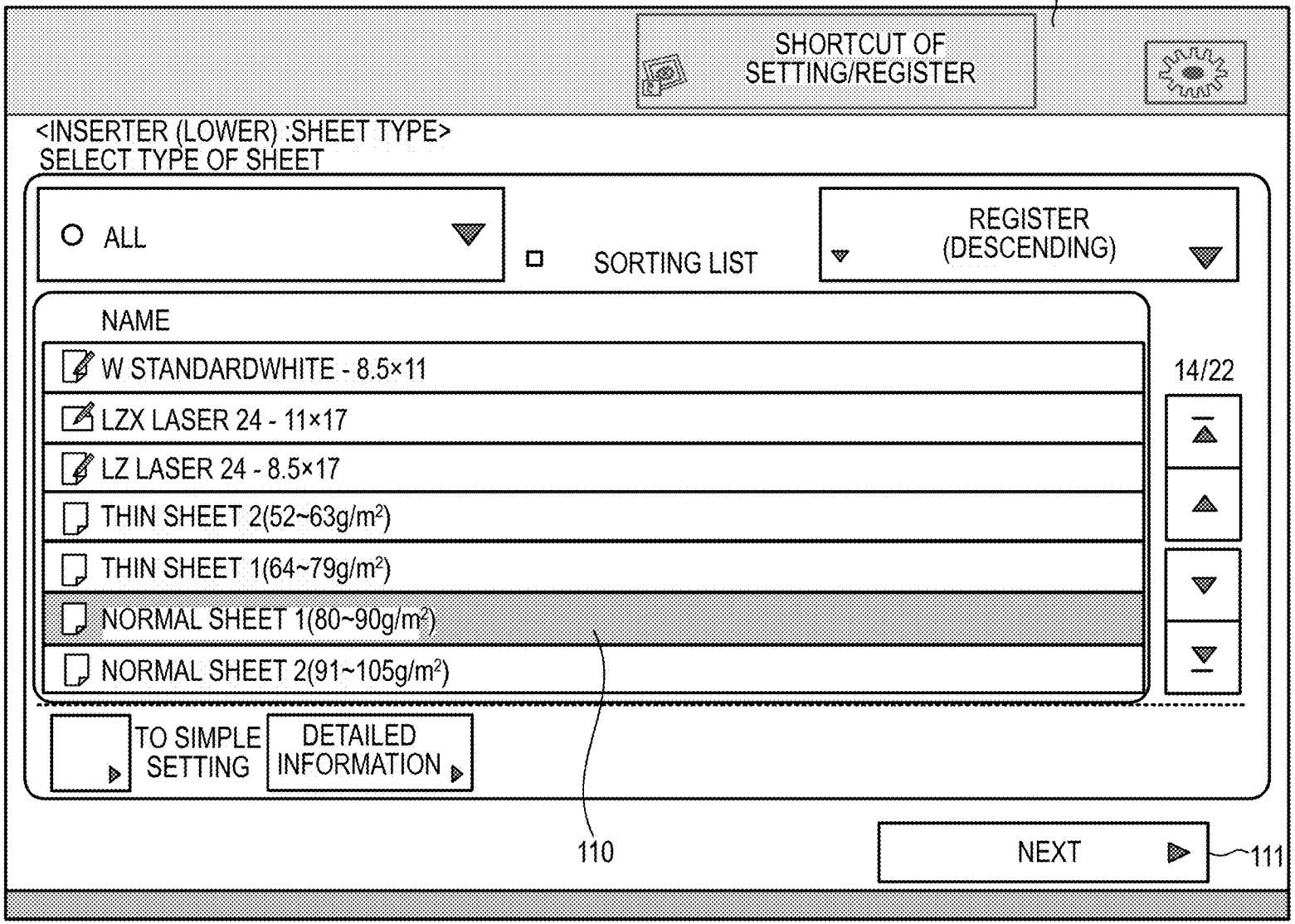
FIG. 4A and FIG. 4B are diagrams illustrating an example of setting screens for inserter automatic sheet switching.
Figure 4B:
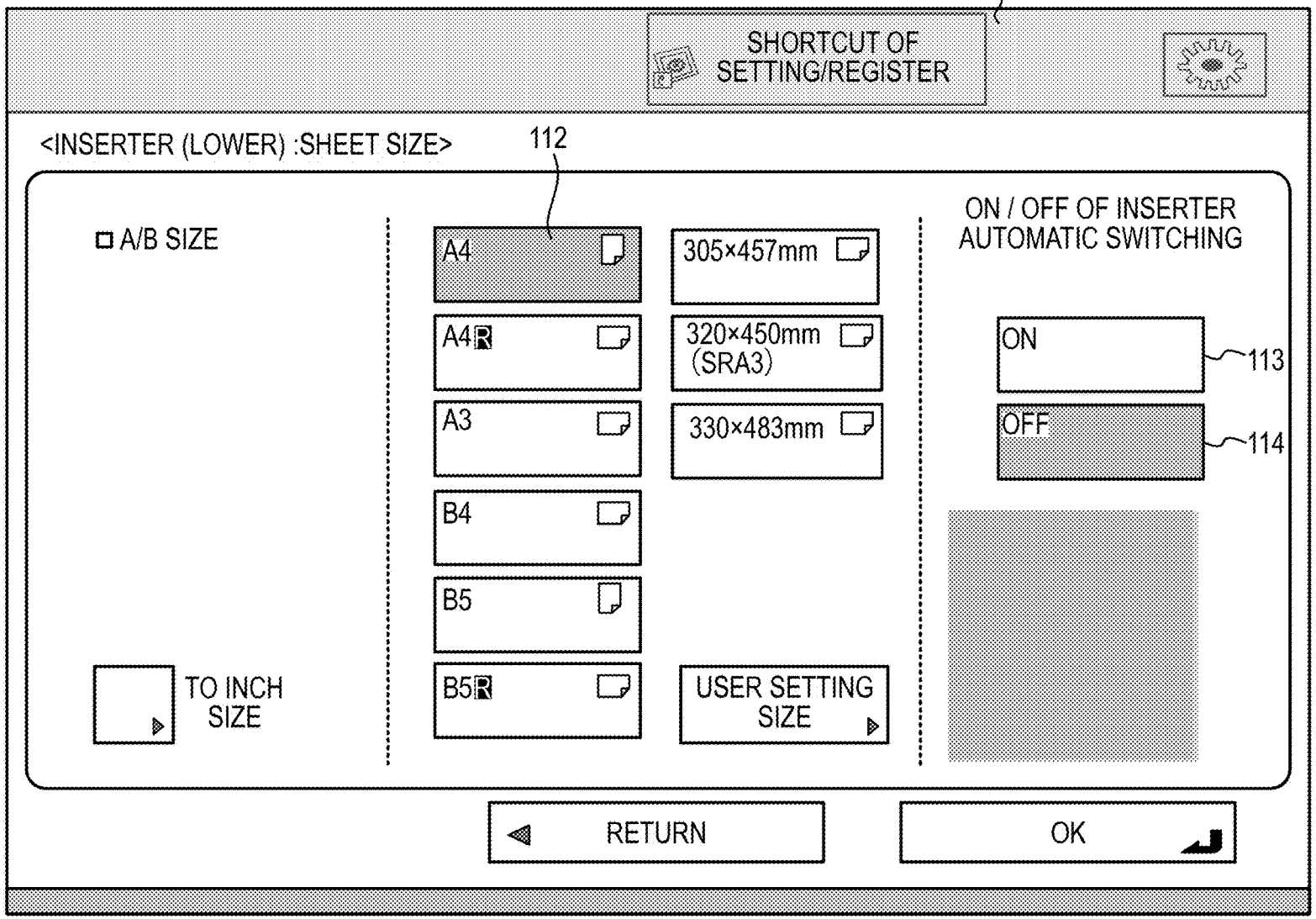

FIG. 4A and FIG. 4B are diagrams illustrating an example of setting screens for inserter automatic sheet switching in the image forming system 100. These setting screens are displayed on the user interface 11 as operable, in response to user operations.

The screen illustrated in FIG. 4A allows a user to select a sheet type of the first feeding tray 320 and the second feeding tray 321. The example illustrated in FIG. 4A illustrates an example of selecting a "Normal sheet (80 to 90 g/m$^2$)" for the first feeding tray 320 (Inserter (Lower)) from a sheet selection list 110. When a "Next" button 111 is pressed in the screen illustrated in FIG. 4A, the screen makes a transition to the screen illustrated in FIG. 4B.

The screen illustrated in FIG. 4B allows a user to use a button 112 and the like to select a sheet size of the first feeding tray 320 and the second feeding tray 321. The example illustrated in FIG. 4B illustrates an example of selecting "A4" as the sheet size of the first feeding tray 320 (Inserter (Lower)).

The user is also allowed to use buttons 113 and 114 to select ON/OFF of an inserter automatic switching sheet setting (hereafter, called an "automatic switching setting"). The example illustrated in FIG. 4B illustrates an example of selecting inserter automatic sheet switching "OFF" (automatic switching disabled). Turning the inserter automatic sheet switching "ON" (automatic switching enabled) means that the first feeding tray 320 and the second feeding tray 321 are candidates of an automatic switching target of a print job when the sheet type and the sheet size of the print job match the sheet types and the sheet sizes of the first feeding tray 320 and the second feeding tray 321. In a case in which there are a plurality of candidates of the automatic switching target, the automatic switching target is selected according to predetermined priorities; in the case of the image forming system of the present embodiment, the highest priority is given to the first feeding tray 320, and the next highest priority is given to the second feeding tray 321. Setting information on the inserter automatic sheet switching set from the screens illustrated in FIG. 4A and FIG. 4B as described above is stored in the ROM 902 of the printer control portion 900, for example.

Figure 5:
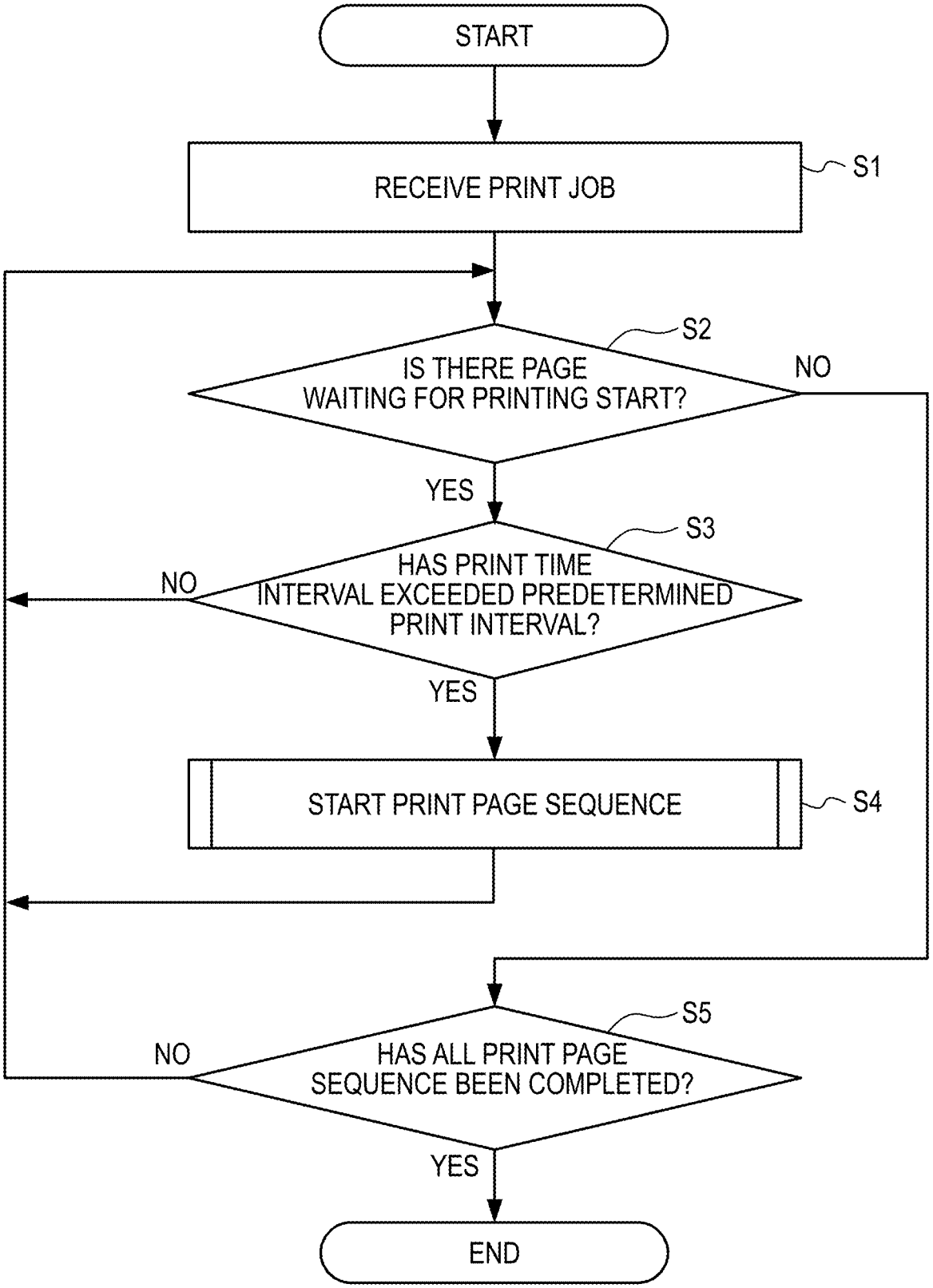
FIG. 5 is a flowchart of a process performed by a printer control portion.

FIG. 5 is a flowchart relating to a job control process performed by the printer control portion 900 in the image forming apparatus 1 of the present embodiment. The processes of flowcharts illustrated in FIG. 5, and FIG. 6A, FIG. 6B, FIG. 6C, and FIG. 7 described later are implemented by the CPU 901 of the printer control portion 900 executing the control programs stored in the ROM 902.

In S1, when receiving a print job, the printer control portion 900 advances the process to S2. In S2, the printer control portion 900 determines whether there is a page waiting for a printing start. When determining that there is the page waiting for the printing start (YES in S2), the printer control portion 900 advances the process to S3. In S3, the printer control portion 900 checks a print time interval using a timer (not illustrated) to determine whether the print time interval has exceeded a predetermined print interval. When determining that the print time interval is less than the predetermined print interval (NO in S3), the printer control portion 900 returns the process to S2.

In contrast, when determining that the print time interval has exceeded the predetermined print interval (YES in S3), the printer control portion 900 advances the process to S4. In S4, the printer control portion 900 starts a print page sequence and returns the process to S2. The print page sequence in S4 is processed in parallel to this flowchart. The print page sequence in S4 will be illustrated in detail in FIG. 6A, FIG. 6B, and FIG. 6C to be described later.

In the above S2, the steps of S3 to S4 are repeated until there is a page waiting for a printing start. When determining that there is no page waiting for the printing start (NO in S2), the printer control portion 900 advances the process to S5.

In S5, the printer control portion 900 determines whether the print page sequence has been completed. When determining that there is an uncompleted print page sequence (NO in S5), the printer control portion 900 returns the process to S2. In contrast, when determining that all print page sequences have been completed (YES in S5), the printer control portion 900 ends the print job.

Figure 6B:
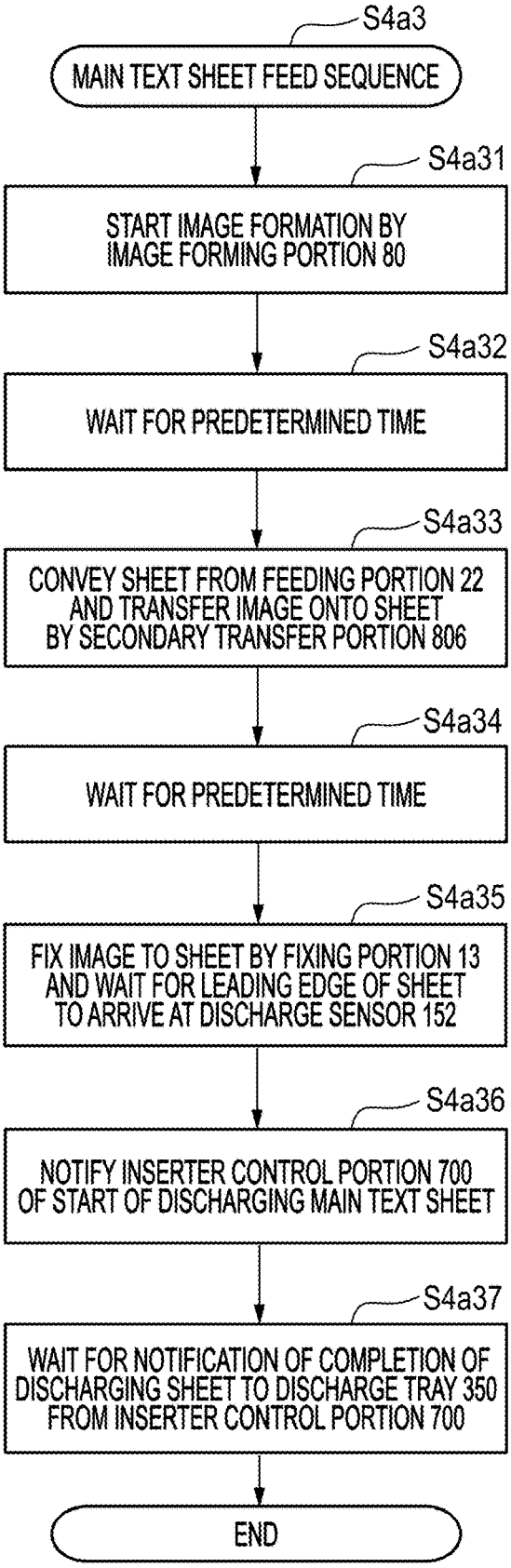
Figure 6C:
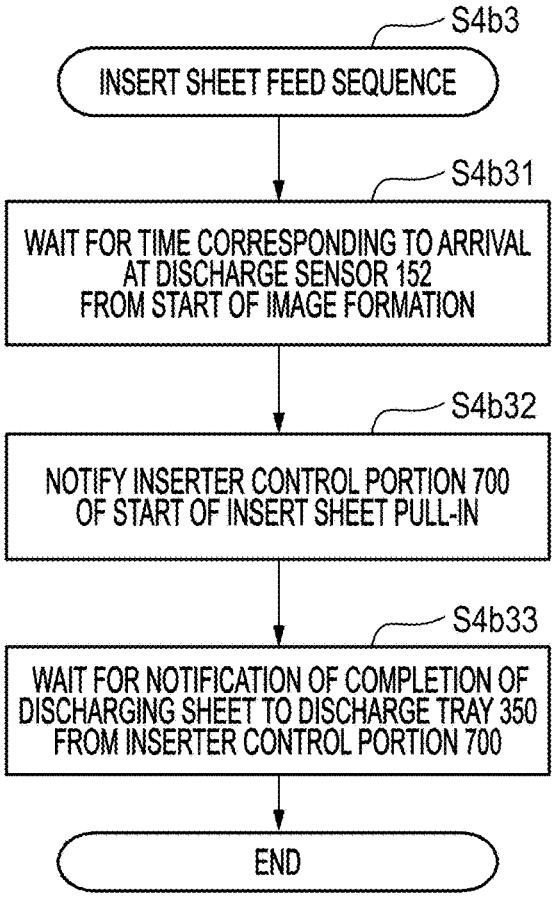

FIG. 6A, FIG. 6B, and FIG. 6C are diagrams illustrating an example of a print page sequence starting process in the image forming apparatus 1 of the present embodiment. This process corresponds to the process of S4 illustrated in FIG. 5. First, in S41, the printer control portion 900 determines whether a print page of the print page sequence is a main text sheet or an insert sheet. When determining that the print page is a main text sheet (YES in S41), the printer control portion 900 performs the process of a main text sheet feed block B1.

<Main Text Sheet Feed Block B1>

First, in S4*a*1, the printer control portion 900 performs main text sheet feed determination illustrated in FIG. 7 to be described later and advances the process to S4*a*2. In S4*a*2, the printer control portion 900 determines whether the main text sheet feed determination in S4*a*1 has resulted in "Main text sheet is feedable". When determining that the main text sheet feed determination has results in "Main text sheet is unfeedable" (NO in S4*a*2), the printer control portion 900 advances the process to S4*a*5. In S4*a*5, the printer control portion 900 ends the print page sequence with sheet unfeedable.

In contrast, when determining in S4*a*2 that the main text sheet feed determination has resulted in "Main text sheet is feedable" (YES in S4*a*2), the printer control portion 900 advances the process to S4*a*3. In S4*a*3, the printer control portion 900 starts a main test sheet feed sequence, which will be described later with reference to FIG. 6B. Next, in S4*a*3, the printer control portion 900 ends the print page sequence only after the completion of the main test sheet feed sequence.

<Main Text Sheet Feed Sequence (S4*a*3)>

The main test sheet feed sequence (S4*a*3) illustrated in FIG. 6B is processed in parallel to the print page sequence (S4). In S4*a*31, the printer control portion 900 starts image formation by the image forming portion 80. Next, in S4*a*32, the printer control portion 900 advances the process to S4*a*33 after waiting for a predetermined time. This predetermined time is a time set such that an image formed by the image forming portion 80 is transferred onto a sheet conveyed from the feeding portion 22 in the secondary transfer portion 806 with good timing. In S4*a*33, the printer control portion 900 feeds a sheet from the feeding portion 22 and transfers the image onto the sheet by the secondary transfer portion 806.

In S4*a*34, the printer control portion 900 advances the process to S4*a*35 only after waiting for a predetermined time for the sheet to arrive at the fixing portion 13 from the secondary transfer portion 806. In S4*a*35, the printer control portion 900 fixes the image to the sheet by the fixing portion 13 and waits for the leading edge of the sheet to arrive at the discharge sensor 152. When the leading edge of the sheet arrives at the discharge sensor 152, the printer control portion 900 advances the process to S4*a*36.

In S4*a*36, the printer control portion 900 starts discharging the sheet to the inserter 3 and notifies the inserter control portion 700 of the start of discharging the main text sheet. In S4*a*37, the printer control portion 900 waits for a notification of completion of discharging the sheet to be received from the inserter control portion 700, the notification of completion of discharging the sheet indicating that the discharge of the main text sheet to the discharge tray 350 of the inserter 3 has been completed. Receiving the notification of completion of discharging the sheet, the printer control portion 900 ends the main text sheet feed sequence.

Return to the description of the main flow of the print page sequence. When determining in S41 that the print page of the print page sequence is an insert sheet (NO in S41), the printer control portion 900 performs the process of an insert sheet feed block B2.

<Insert Sheet Feed Block B2>

Here, the description is given using an example in which the first feeding tray 320 of the inserter 3 is specified as a feeding tray of insert sheets. First, the printer control portion 900 notifies the inserter control portion 700 of an "insert sheet feed preparation notification" from the first feeding tray 320 (S4*b*2) and starts an insert sheet feed sequence, which will be described later with reference to FIG. 6C (S4*b*3). The insert sheet feed sequence illustrated in FIG. 6C is processed in parallel to the print page sequence. In response to the "insert sheet feed preparation notification", the inserter control portion 700 starts an insert sheet feed preparation process illustrated in FIG. 8A to be described later.

Next, in S4*b*4, the printer control portion 900 determines whether an insert sheet presence notification has been received from the inserter control portion 700. Here, when a "notification of the unconfirmed presence or absence of an insert sheet notification" has been received, the printer control portion 900 waits an "insert sheet presence notification" or an "insert sheet absence notification" to be received. When determining that the "insert sheet presence notification" has been received (YES in S4*b*4), the printer control portion 900 advances the process to S4*b*5.

In S4*b*5, the printer control portion 900 determines whether a "notification of the completion of feeding an insert sheet" from the inserter control portion 700 has been received. When determining that the "notification of the completion of feeding an insert sheet" from the inserter control portion 700 has not been received yet (NO in S4*b*5), the printer control portion 900 returns the process to S4*b*4. In contrast, when determining that the "notification of the completion of feeding an insert sheet" from the inserter control portion 700 has been received (YES in S4*b*5), the printer control portion 900 advances the process to S4*b*6. In S4*b*6, the printer control portion 900 ends the print page sequence only after the completion of the insert sheet feed sequence.

In contrast, when determining that the "insert sheet absence notification", which will be described later, has been received from the inserter control portion 700 (NO in S4*b*4), the printer control portion 900 performs a process of a block B3 for automatic switching. Note that, although not illustrated in FIG. 6A, the printer control portion 900 is supposed to perform the process of the block B3 for automatic switching in the case in which ON of the automatic switching is set on the screen illustrated in FIG. 4B. In contrast, the printer control portion 900 is supposed to advance the process to S4*b*9 without performing the process of the block B3 for automatic switching in the case in which OFF of the automatic switching is set on the screen illustrated in FIG. 4B.

<Block for Automatic Switching B3>

First, in S4*c*1, the printer control portion 900 uses information on the inserter sheet remaining amount sensor or the like to check for any feeding tray other than the selected feeding tray that is capable of feeding insert sheets and has the same sheet type and sheet size as the sheet type and the sheet size of the selected feeding tray (hereafter, referred to as an "available tray"). Next, when determining in S4*c*2 that there is an available tray (YES in S4*c*2), the printer control portion 900 advances the process to S4*c*3.

In S4*c*3, the printer control portion 900 switches the feeding tray. Next, in S4*b*8, the printer control portion 900 notifies the inserter control portion 700 of the "insert sheet feed preparation notification" to feed an insert sheet from a feeding tray that has been switched to, and makes a transition of the process to S4*b*5.

In contrast, when determining in the above S4*c*2 that there is no available tray (NO in S4*c*2), the printer control portion 900 advances the process to S4*b*9. In S4*b*9, the printer control portion 900 cancels the insert sheet feed sequence and ends the print page sequence with sheet unfeedable.

<Insert Sheet Feed Sequence (S4*b*3)>

The insert sheet feed sequence illustrated in FIG. 6C is processed in parallel to the print page sequence. First, in S4*b*31, the printer control portion 900 advances the process to S4*b*32 after waiting a time taken for a main text sheet to arrive at the discharge sensor 152 from the start of the image formation of the main text sheet. In S4*b*32, the printer control portion 900 notifies the inserter control portion 700 of a "notification of the start of Insert sheet pull-in" (S4*b*32). In response to the "notification of the start of Insert sheet pull-in", the inserter control portion 700 starts an insert sheet pull-in start process illustrated in FIG. 8B to be described later. This enables a main text sheet and an insert sheet to be inserted with good timing without a decrease in productivity.

Next, in S4*b*33, the printer control portion 900 waits for a notification of completion of discharging the sheet to be received from the inserter control portion 700, the notification of completion of discharging the sheet indicating that the discharge of an insert sheet to the discharge tray 350 of the inserter 3 has been completed. When receiving the notification of completion of discharging the sheet from the inserter control portion 700, the printer control portion 900 ends the insert sheet feed sequence.

FIG. 7 is a flowchart illustrating an example of a main text sheet feed determination process in the image forming apparatus of the present embodiment. This process corresponds to the process of S4*a*1 illustrated in FIG. 6A. First, in S4*a*11, the printer control portion 900 determines whether an immediately-before-sheet of the main text sheet is an insert sheet. When determining that the immediately-before-sheet of the main text sheet is not an insert sheet (NO in S4*a*11), the printer control portion 900 advances the process to S4*a*13.

In S4*a*13, the printer control portion 900 determines whether there are any main text sheets in the sheet stacker 220. When determining that there is a main text sheet in the sheet stacker 220 (YES in S4*a*13), the printer control portion 900 determines that "Main text sheet is feedable" (S4*a*14) and returns the process to a caller. In contrast, when determining in S4*a*13 that there is no main text sheet in the sheet stacker 220 (NO in S4*a*13), the printer control portion 900 determines that "Main text sheet is unfeedable" (S4*a*19) and ends the main text sheet feed determination process.

When determining in S4*a*11 that the immediately-before-sheet of the main text sheet is an insert sheet (YES in S4*a*11), the printer control portion 900 advances the process to S4*a*12. In S4*a*12, the printer control portion 900 checks whether the remaining amount of insert sheets on the feeding tray used in the job in the inserter 3 is high. For example, the printer control portion 900 may determine that the remaining amount on the feeding tray is high when the remaining amount of the insert sheets is higher than a predetermined amount. Alternatively, for example, the printer control portion 900 may determine that the remaining amount on the feeding tray is low when the remaining amount of the insert sheets is lower than the predetermined amount. The predetermined amount is any value that can be set as appropriate. The remaining amount on the feeding tray can be detected using the first inserter sheet remaining amount sensor 721 and the second inserter sheet remaining amount sensor 722.

When determining in S4*a*12 that the remaining amount on the feeding tray is high (YES in S4*a*12), the printer control portion 900 advances the process to S4*a*13. In this case, the printer control portion 900 permits the feeding of the main text sheet without waiting the confirmation of the presence or absence of an insert sheet. Hereafter, this feeding control will be called an "operation without confirming the presence or absence of an insert sheet".

In contrast, when determining in S4*a*12 that the remaining amount of the insert sheets on the feeding tray used in the job in the inserter 3 is not high (low or out) (NO in S4*a*12), the printer control portion 900 performs the process of the block B3 for automatic switching. Details of the process of the block B3 automatic switching will be omitted.

The printer control portion 900 performs the process of the block B3 for automatic switching to determine whether there is any "available tray" described above. When determining that there is an available tray (YES in S4*c*2'), the printer control portion 900 advances the process to S4*a*16. When determining that there is no available tray (NO in S4*c*2'), the printer control portion 900 determines that there is no feeding tray as a switch destination and advances the process to S4*a*17.

In S4*a*16, the printer control portion 900 determines whether the remaining amount on the feeding tray as a switch destination is high. When determining that the remaining amount on the feeding tray as a switch destination is high (YES in S4*a*16), the printer control portion 900 advances the process to S4*a*13. That is, even when the remaining amount on the feeding tray used in the job is low or runs out, the operation without confirming the presence or absence of an insert sheet is continued as long as the feeding tray as an automatic switching destination is stacked with insert sheets sufficiently. Conventionally, a deterioration in productivity occurs when the remaining amount of insert sheets is determined to be low or out, but this process allows the configuration of the present embodiment to keep productivity.

In contrast, when determining in S4*a*16 that the remaining amount on the feeding tray as a switch destination is not high (low or out) (NO in S4*a*16), the printer control portion 900 advances the process to S4*a*17.

When there is no automatic switching destination, or when the remaining amount on the feeding tray as a switch destination is low or out in S4*a*16, the printer control portion 900 waits in S4*a*17 until the presence or absence of the immediately-before-sheet of the insert sheet is confirmed.

Here, "presence or absence of an insert sheet on a feeding tray", and "unconfirmed presence or absence of sheet", "confirmation of sheet presence", and "confirmation of sheet absence" about an insert sheet will be described. The "presence or absence of an insert sheet on a feed tray" can be detected by the inserter sheet remaining amount sensor. However, while being capable of detecting that the remaining amount of insert sheets is "high" or "low or out", the inserter sheet remaining amount sensor is not accurate in detecting the remaining amount to one inserter sheet. Therefore, in the case in which one insert sheet is fed and the next insert sheet is prepared for feeding, the "sheet presence" or "sheet absence" of the next insert sheet is confirmed when the feeding of the preceding insert sheet is completed, and the trailing edge of the next insert sheet is passed through the inserter sheet remaining amount sensor, and a state before that is a state of "unconfirmed presence or absence of sheet". As described above, in addition to the "presence or absence of a sheet on a feeding tray", an insert sheet can enter one of three states of "unconfirmed presence or absence of sheet", "confirmation of sheet presence", and "confirmation of sheet absence".

Now, return to the description of the flowcharts. In S4*a*18, the printer control portion 900 determines whether the "sheet presence" of the insert sheet of the immediately-before-sheet is confirmed. When determining that the "sheet presence" of the insert sheet of the immediately-before-sheet is confirmed (YES in S4*a*18), the printer control portion 900 advances the process to S4*a*13. That is, the printer control portion 900 determines whether there is any feedable main text sheet on the sheet stacker 220, and when a main text sheet is feedable (S4*a*13), the printer control portion 900 determines that the "Main text sheet is feedable" (S4*a*14). In contrast, when there is no main text sheet on the sheet stacker 220, the printer control portion 900 determines that the "Main text sheet is unfeedable" (S4*a*19).

In contrast, when determining in S4*a*18 that the "sheet absence" of insert sheet of the immediately-before-sheet is confirmed (NO in S4*a*18), the printer control portion 900 determines in S4*a*19 that the feeding of a main text sheet is disabled ("Main text sheet is unfeedable").

In such a manner, when it is determined in the block B3 for automatic switching that there is no "available tray", or the remaining amount of an insert sheet on the feeding tray as a switch destination is "low or out", the printer control portion 900 permits or rejects the feeding of a main text sheet after waiting the confirmation of the presence or absence of an insert sheet. Hereafter, this operation will be called an "operation of confirming the presence or absence of an insert sheet". The "operation of confirming the presence or absence of an insert sheet" decreases the productivity as in conventional practices but can prevent an inconsistency occurring in a product when the "operation without confirming the presence or absence of an insert sheet" is performed.

Figure 8A:
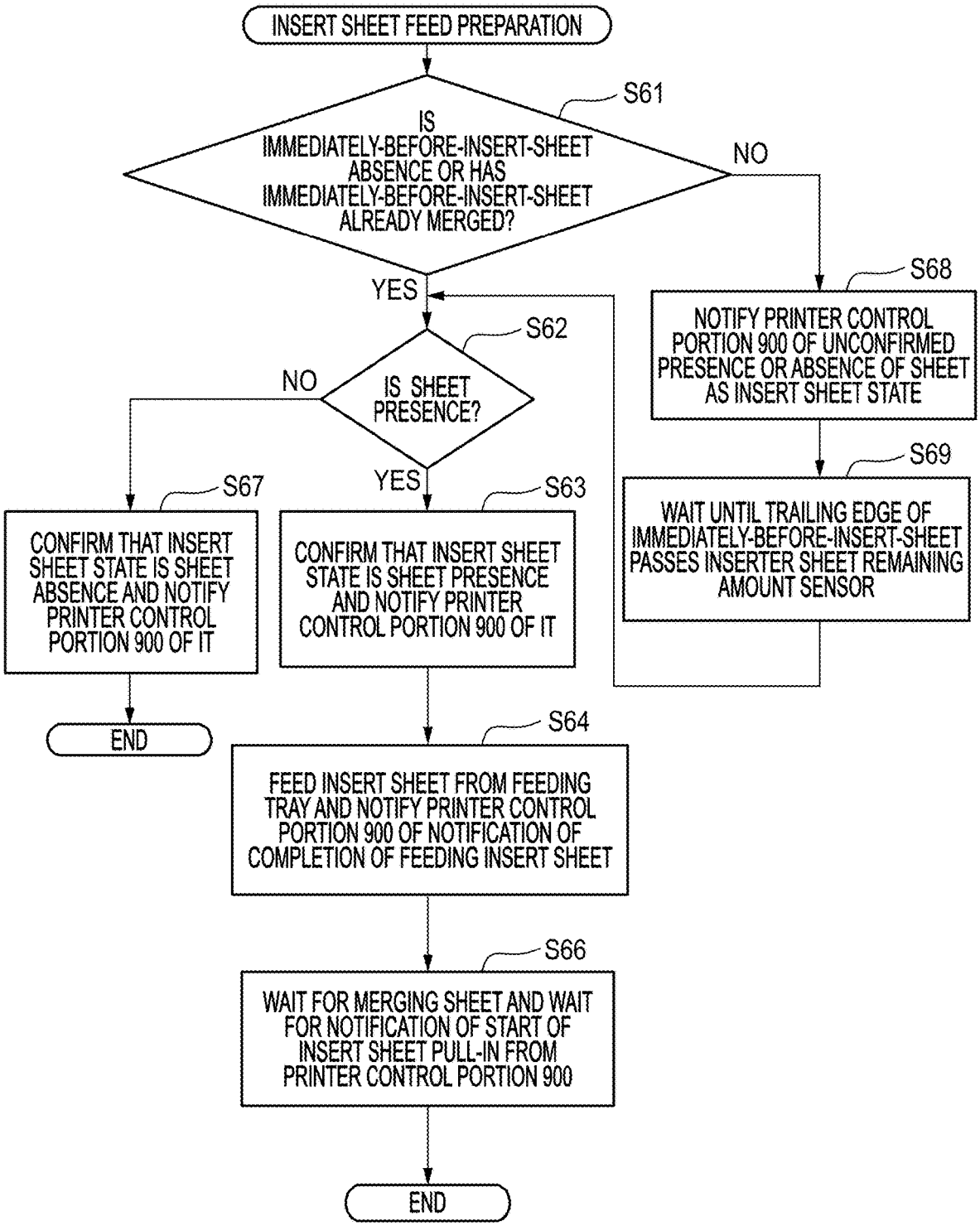
FIG. 8A and FIG. 8B are flowcharts of processes performed by an inserter control portion.
Figure 8B:
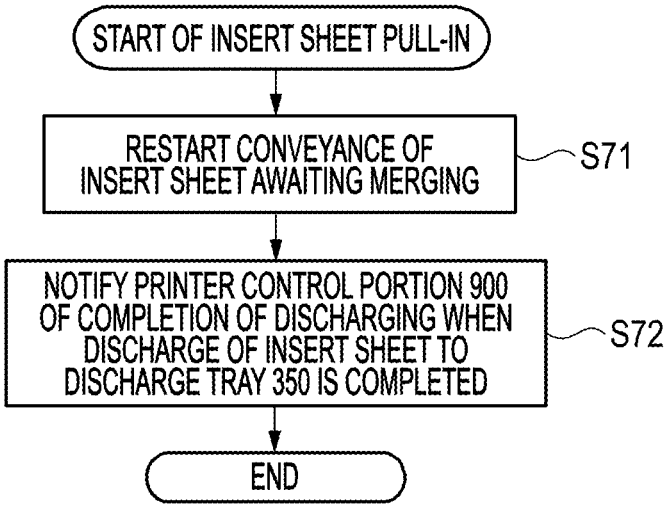

FIG. 8A and FIG. 8B are flowcharts illustrating an example of processes (insert sheet feed preparation process, insert sheet pull-in start process) performed by the inserter control portion 700 in the image forming system of the present embodiment. The processes of flowcharts illustrated in FIG. 8A and FIG. 8B are implemented by the CPU 701 of the inserter control portion 700 executing the control programs stored in the ROM 702.

The flowchart illustrated in FIG. 8A corresponds to the insert sheet feed preparation process that the inserter control portion 700 performs when notified of the "insert sheet feed preparation" illustrated as S4*b*2 and the like in FIG. 6A by the printer control portion 900. In the insert sheet feed preparation process, first, the inserter control portion 700 determines in S61 whether an immediately-before-insert-sheet is absent, or whether the immediately-before-insert-sheet has already been conveyed for merging, and the trailing edge of the immediately-before-insert-sheet has been passed through the inserter sheet remaining amount sensor. When determining that the immediately-before-insert-sheet is absent or that the immediately-before-insert-sheet has been conveyed for merging, and the trailing edge of the immediately-before-insert-sheet has been passed through the inserter sheet remaining amount sensor (YES in S61), the inserter control portion 700 advances the process to S62.

In contrast, when determining that the trailing edge of the immediately-before-insert-sheet has not been passed through the inserter sheet remaining amount sensor yet (NO in S61), the inserter control portion 700 advances the process to S68. In S68, the inserter control portion 700 confirms that the insert sheet state is "unconfirmed presence or absence of sheet" and notifies the printer control portion 900 of a "notification of unconfirmed presence or absence of sheet" about the insert sheet. In S69, the inserter control portion 700 waits until the trailing edge of the immediately-before-insert-sheet is passed through the inserter sheet remaining amount sensor. When the trailing edge of the immediately-before-insert-sheet has passed through the inserter sheet remaining amount sensor, the inserter control portion 700 advances the process to S62.

In S62, the inserter control portion 700 determines the presence or absence of the insert sheet in question (an insert sheet relevant to the "insert sheet feed preparation notification"). When determining that the insert sheet in question is absent (NO in S62), the inserter control portion 700 advances the process to S67. In S67, the inserter control portion 700 confirms that the insert sheet state is "sheet absence" and notifies the printer control portion 900 of an "insert sheet absence notification", and ends the process of this flowchart.

In contrast, when determining in S62 that the insert sheet in question is present (YES in S62), the inserter control portion 700 advances the process to S63. In S63, the inserter control portion 700 confirms that the insert sheet state is "sheet presence" and notifies the printer control portion 900 of an "insert sheet presence notification".

In S64, the inserter control portion 700 feeds an insert sheet from the feeding tray and notifies the printer control portion 900 of a "notification of the completion of feeding an insert sheet". In S66, the inserter control portion 700 causes the insert sheet to wait for merging and waits a "notification of the start of insert sheet pull-in" from the printer control portion 900. When receiving the "notification of the start of insert sheet pull-in" from the printer control portion 900, the inserter control portion ends the process of this flowchart.

The flowchart illustrated in FIG. 8B corresponds to the insert sheet pull-in start process that the inserter control portion 700 performs when notified of the "notification of the start of insert sheet pull-in" illustrated as S**4*b*32 in FIG. 6C by the printer control portion 900. In the insert sheet pull-in start process, the inserter control portion 700 resumes in S71 the conveyance of the insert sheet waiting for merging. Next, in S72, when the discharge of the insert sheet to the discharge tray 350 is completed, the inserter control portion 700 notifies the printer control portion 900** of a "discharge completion notification" and ends the process of this flowchart.

As seen from the above, in the image forming system 100 of the present embodiment, the inserter control portion 700 is notified of the "insert sheet feed preparation notification" from the feeding tray, and the insert sheet feed sequence is started (S**4*b*3). Even when thereafter receiving the "insert sheet absence notification" from the inserter control portion 700 (S4*b*4), as long as there is any feeding tray as a switch destination, the printer control portion 900 does not cancel the insert sheet feed sequence and notifies the feeding tray as a switch destination of feed preparation. As a result, even though the "sheet absence" occurs in a feeding tray of the inserter 3**, an insert sheet job can be continued without a decrease in the productivity.

Figures 9, 9A:
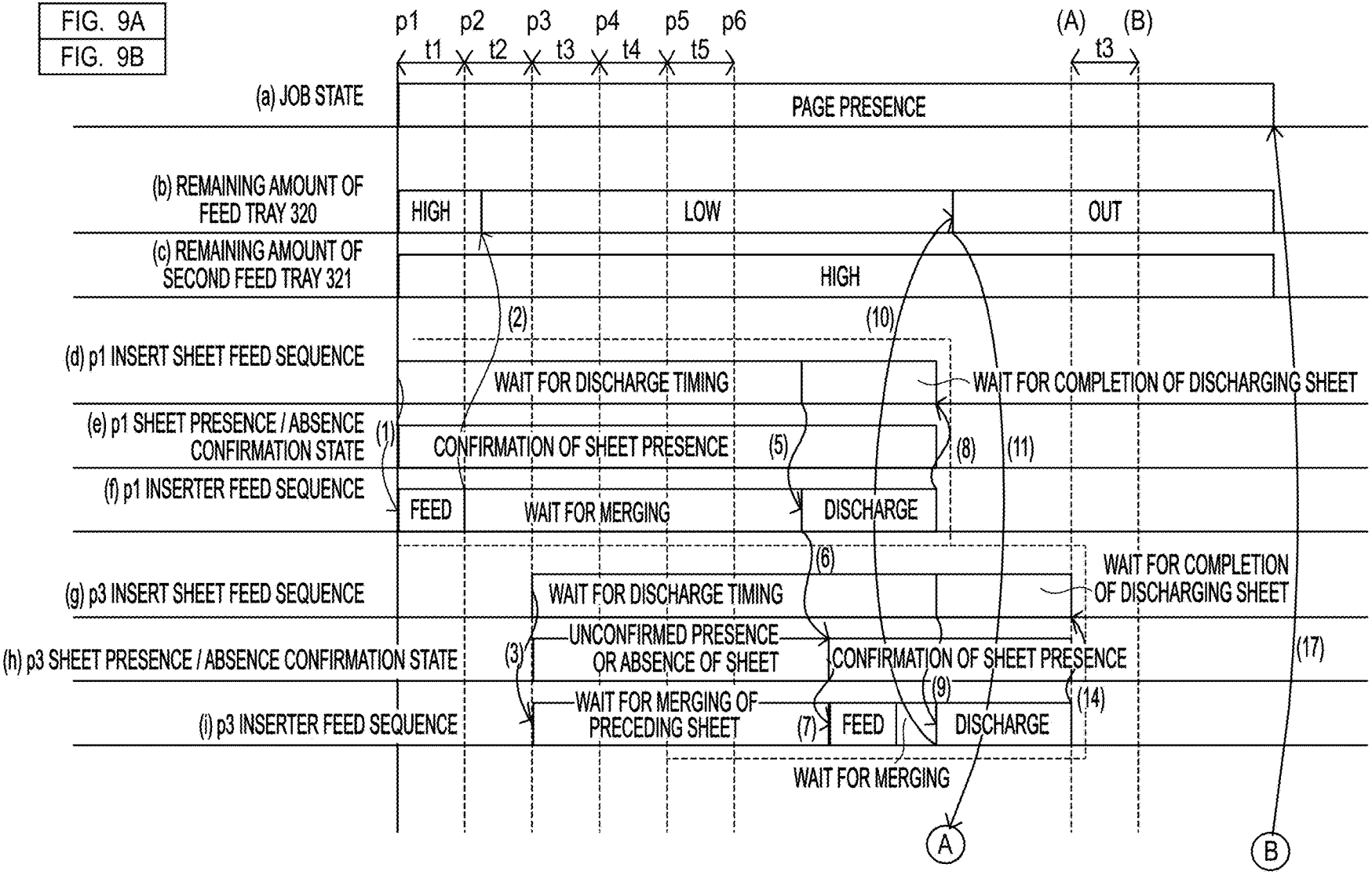
FIG. 9 which is composed of FIG. 9A
Figure 9B:
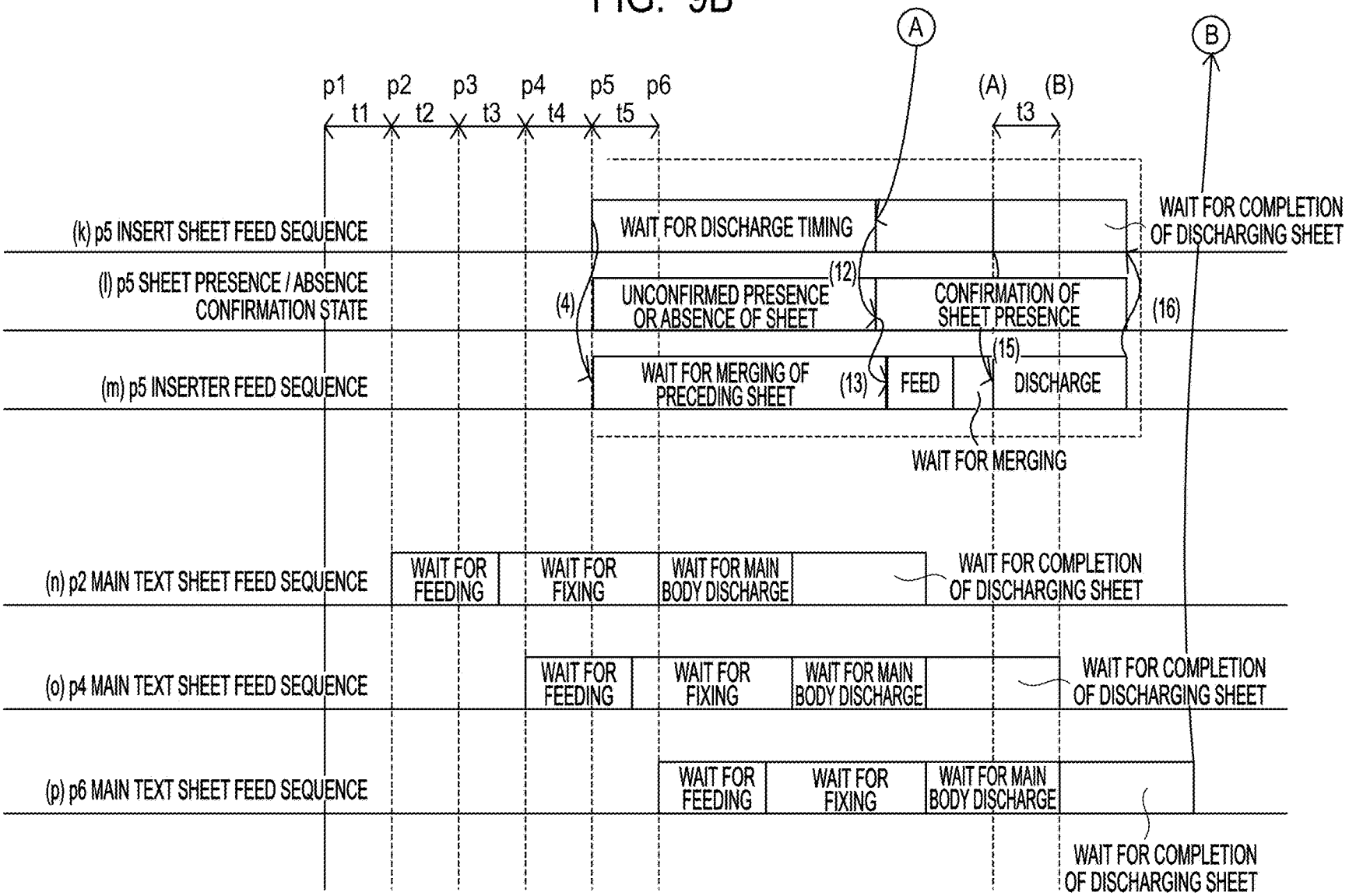
FIG. 9B is a timing chart of the image forming system of the present embodiment.

FIG. 9 which is composed of FIG. 9A and FIG. 9B is a timing chart of a job in the image forming system 100: insert sheet/main text sheet/insert sheet/main text sheet/insert sheet/main text sheet (with page numbers given as p1 to p6), as an example. With reference to the flowcharts illustrated in FIG. 5 to FIG. 7, an operation of the image forming system 100 by the present embodiment will be described.

The row (a) Job State indicates whether there is a page waiting for printing start in the flowchart illustrated in FIG. 5. The job state becomes "page presence" concurrently with the start of the job, and the job ends concurrently with the end of a main text sheet feed sequence for p6 being a final page (17) (S5 in FIG. 5). When receiving a print job, the image forming system 100 starts print page sequences (S1, S2, S3, S4 in FIG. 5) at predetermined intervals, and print intervals between p1 to p6 are assumed to be t1 to t5, respectively.

The row (b) indicates the remaining amount on the first feeding tray 320. Although being an extreme example, in this example, the state of the first feeding tray 320 is transformed such as, "the remaining amount is high" at the start, "the remaining amount is low" after feeding p1 (2), and "the remaining amount is out" after feeding p3 (10). The row (c) indicates the remaining amount on the second feeding tray 321. In this example, it is assumed that the "remaining amount is high", and insert sheets of the same type and size as the first feeding tray 320 are stacked.

The rows (d), (e), and (f) indicate the state of an insert sheet feed sequence, a sheet presence/absence confirmation state, and the state of an inserter feed sequence, for p1, respectively. The rows (g), (h), and (i) indicate the state of an insert sheet feed sequence, a sheet presence/absence confirmation state, and the state of an inserter feed sequence, for p3, respectively. The rows (k), (l), and (m) indicate the state of an insert sheet feed sequence, a sheet presence/absence confirmation state, and the state of an inserter feed sequence, for p5, respectively. The rows (n), (o), and (p) indicate the states of main text sheet feed sequences for p2, p4, and p6, respectively.

The operation will be described below in detail.

<(d) p1 Insert Sheet Feed Sequence>

First, when the print page sequence for p1 (insert sheet) is started, the inserter control portion 700 is notified of "Insert Sheet Feed Preparation Notification (1)" of the first feeding tray 320, and "(d) p1 Insert Sheet Feed Sequence" is started (S**4*b*2, S4*b*3). At the same time, the inserter control portion 700 starts "(f) Inserter Feed Sequence". There is no insert sheet preceding the insert sheet p1, and "(e) p1 Sheet Presence/Absence Confirmation State" of insert sheet is immediately determined to be the "confirmation of sheet presence". The inserter control portion 700 therefore feeds the insert sheet p1, notifies the printer control portion 900 of the "notification of the completion of feeding an insert sheet (2)", and causes the insert sheet p1 to "wait for merging" (S61, S62, S63, S64, S66**).

In "(d) p1 Insert Sheet Feed Sequence", the printer control portion 900 waits for a time taken for a main text sheet to arrive at the discharge sensor 152 from the start of the image formation of the main text sheet and thereafter notifies the inserter control portion 700 of the "notification of the start of insert sheet pull-in (5)" (S4*b*31, S4*b*32). In response to the "notification of the start of insert sheet pull-in (5)", the inserter control portion 700 resumes the conveyance of the insert sheet p1 waiting for merging and notifies the printer control portion 900 of the "Discharge Completion Notification (8)" of the insert sheet p1 (S71, S72). Receiving the "Discharge Completion Notification (8)" from the inserter control portion 700, the printer control portion 900 ends "(d) p1 Insert Sheet Feed Sequence" (S4*b*33).

<(n) p2 Main Text Sheet Feed Sequence>

After t1 from the start of "(d) p1 Insert Sheet Feed Sequence", "(n) p2 Main Text sheet Feed Sequence" is started in parallel. In the main text sheet feed determination (S4*a*2), since the remaining amount on the first feeding tray 320 for the preceding insert sheet p1 is high (S4*a*12, S4*a*13, S4*a*14), the main text sheet feed sequence is immediately started (S4*a*3).

<(g) p3 Insert Sheet Feed Sequence>

After t2 from the start of "(n) p2 Main Text sheet Feed Sequence", "(g) p3 Insert Sheet Feed Sequence" is started in parallel. As with the print page sequence for the insert sheet p1 described above, the inserter control portion 700 is notified of "Insert Sheet Feed Preparation Notification (3)" from the first feeding tray 320, and "(g) p3 Insert Sheet Feed Sequence" is started (S4*b*2, S4*b*3). When the preceding insert sheet p1 is present in the path, the "(h) p3 Sheet Presence/Absence Confirmation State" is determined to be "unconfirmed presence or absence of sheet" (S61, S68). When the insert sheet p1 preceding the insert sheet p3 quits the wait for merging by the "notification of the start of insert sheet pull-in (5)", and the conveyance is resumed, the "sheet presence" of the insert sheet p3 is confirmed at the time when the trailing edge of the insert sheet p1 is passed through the first inserter sheet remaining amount sensor 721 (6) (S69, S62). In response to the confirmation, the inserter control portion 700 feeds the insert sheet p3 and causes the insert sheet p3 to wait for merging (S63, S64, S66).

In "(g) p3 Insert Sheet Feed Sequence", the printer control portion 900 waits for a time taken for a main text sheet to arrive at the discharge sensor 152 from the start of the image formation of the main text sheet and thereafter notifies the inserter control portion 700 of the "notification of the start of insert sheet pull-in (9)" (S4*b*31, S4*b*32). The inserter control portion 700 resumes the conveyance of the insert sheet p3 waiting for merging and notifies the printer control portion 900 of the "Discharge Completion Notification (14)" of the insert sheet p3 (S71, S72). Receiving the "Discharge Completion Notification (14)" from the inserter control portion 700, the printer control portion 900 ends "(g) p3 Insert Sheet Feed Sequence" (S4*b*33).

<(o) p4 Main Text Sheet Feed Sequence>

After t3 from the start of "(g) p3 Insert Sheet Feed Sequence", "(o) p4 Main Text sheet Feed Sequence" is started in parallel. In the main text sheet feed determination (S4*a*1), since the remaining amount on the first feeding tray 320 for the preceding insert sheet p3 is low, the printer control portion 900 finds another feedable tray (S4*a*12, S4*c*1). In this example, since the second feeding tray 321 is found, and the remaining amount on the second feeding tray 321 is high, the second feeding tray 321 is determined to be feedable (S4*c*2', S4*a*16, S4*a*13, S4*a*14), and the "(o) p4 Main Text sheet Feed Sequence" is immediately started. At this point, the "sheet presence or absence" of the preceding insert sheet p3 is "unconfirmed", and the printer control portion 900 permits the feeding of the main text sheet without waiting for the sheet presence/absence confirmation, that is, performs the operation without confirming the presence or absence of an insert sheet, by which the productivity is improved.

<(k) p5 Insert Sheet Feed Sequence>

After t4 from the start of "(o) p4 Main Text sheet Feed Sequence", "(k) p5 Insert Sheet Feed Sequence" is started in parallel. As with the print page sequence for the insert sheet p3, the inserter control portion 700 is notified of "Insert Sheet Feed Preparation Notification (4)" from the first feeding tray 320, and "(m) p5 Insert Sheet Feed Sequence" is started (S4*b*2, S4*b*3). If the preceding insert sheet p3 is present in the path, the "(l) p5 Sheet Presence/Absence Confirmation State" is determined to be "unconfirmed presence or absence of sheet" (S61, S68).

When the insert sheet p3 preceding the insert sheet p5 quits the wait for merging by the "notification of the start of insert sheet pull-in (9)", and the conveyance is resumed, the "sheet absence" of the insert sheet p5 is confirmed at the time when the trailing edge of the insert sheet p3 is passed through the first inserter sheet remaining amount sensor 721 (10) (S69, S62, S67). In the print page sequence, receiving the sheet absence notification of the insert sheet p5 (S4*b*4), the printer control portion 900 finds another feedable tray as an automatic switching destination (S4*c*1). In this example, the second feeding tray 321 is found as an available feeding tray, and the second feeding tray 321 is determined to be feedable (S4*c*2). The inserter control portion 700 is notified of "Insert Sheet Feed Preparation Notification (13)" from the second feeding tray 321 (S4*b*8).

Since the insert sheet p3 preceding the insert sheet p5 has already been conveyed, and "(l) p5 Sheet Presence/Absence Confirmation State" is immediately confirmed as "sheet presence" (12), the inserter control portion 700 feeds the insert sheet p5 and causes the insert sheet p5 to wait for merging (S61, S62, S63, S64, S66). The "(k) p5 Insert Sheet Feed Sequence" is continued, and the printer control portion 900 waits for a time taken for a main text sheet to arrive at the discharge sensor 152 from the start of the image formation of the main text sheet and thereafter notifies the inserter control portion 700 of the "notification of the start of insert sheet pull-in (15)" (S4*b*31, S4*b*32). The inserter control portion 700 resumes the conveyance of the insert sheet p5 waiting for merging and notifies the printer control portion 900 of the "Discharge Completion Notification (16)" of the insert sheet p5 (S71, S72). Receiving the "Discharge Completion Notification (16)" from the inserter control portion 700, the printer control portion 900 ends "(k) p5 Insert Sheet Feed Sequence" (S4*b*33).

<(p) p6 Main Text Sheet Feed Sequence>

After t5 from the start of "(k) p5 Insert Sheet Feed Sequence", "(p) p6 Main Text sheet Feed Sequence" is started in parallel. The rest of this sequence is the same as the sequence for the main text sheet p4 and therefore will not be described.

As seen from the above, even when the remaining amount on a feeding tray of the inserter 3 is low or out, the operation without confirming the presence or absence of an insert sheet can be continued in the feeding of a main text sheet, and thus the productivity can be improved. For example, in terms of a discharge interval between the insert sheet p3 and the main text sheet p5 (from (A) to (B) in FIG. 9A and FIG. 9B), the same productivity as a productivity substantially equivalent to "t3" as a feeding interval can be kept.

Figures 10, 10A:
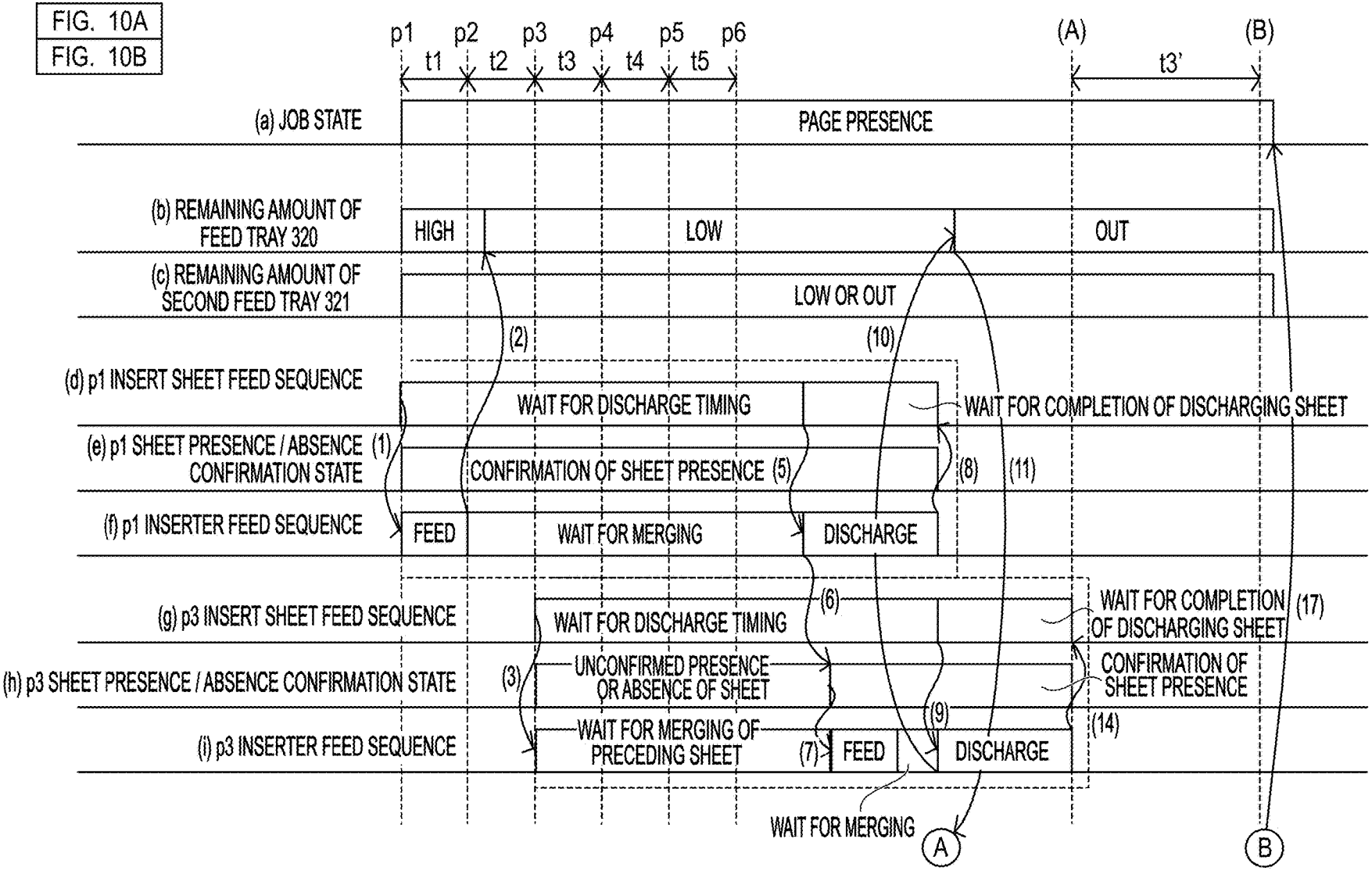
FIG. 10 which is composed of FIG. 10A
Figure 10B:
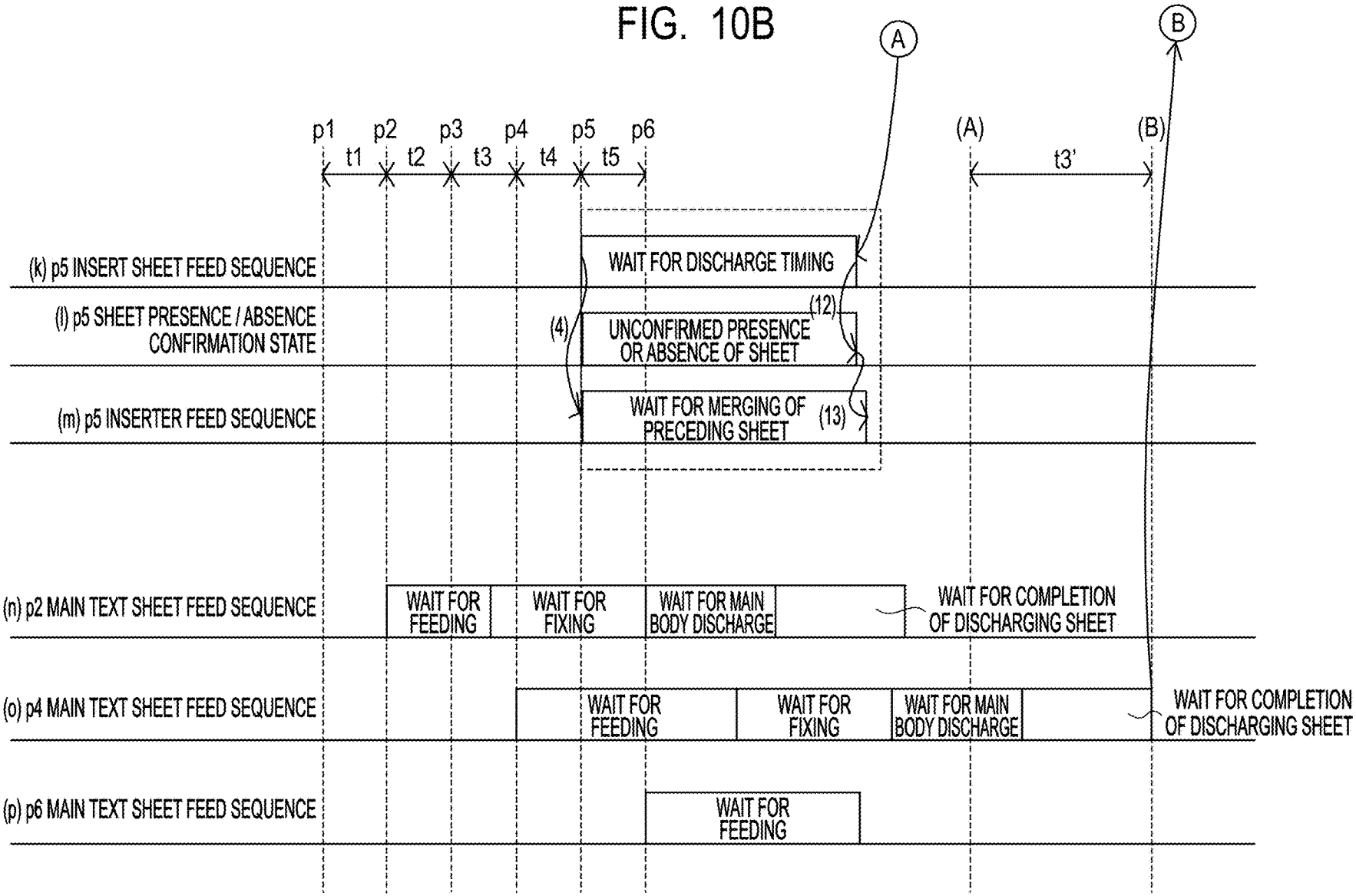
FIG. 10B is a timing chart of the image forming system of the present embodiment.

FIG. 10 which is composed of FIG. 10A and FIG. 10B is a timing chart of a job in the image forming system 100: insert sheet/main text sheet/insert sheet/main text sheet/insert sheet/main text sheet (with page numbers given as p1 to p6), as another example. The description will be given focusing on differences from FIG. 9A and FIG. 9B.

In this example, the remaining amount on the second feeding tray 321 is assumed to be low or out. This example holds true for the case in which the second feeding tray 321 is stacked with insert sheets of sheet type and size different from the sheet type and size of the first feeding tray 320 and the case in which the second feeding tray 321 is not selected as an automatic switching target.

<(o) p4 Main Text Sheet Feed Sequence>

In this example, since finding the other feeding tray in the main text sheet feed determination (S4*a*1) (S4*a*12, S4*c*1) fails to find an available tray, the printer control portion 900 waits until the presence/absence of the insert sheet p3 of the immediately-before-sheet is confirmed (S4*c*2', S4*a*17). Since the "sheet presence" of the insert sheet p3 is confirmed with a timing of (6), it is determined that "Main text sheet is feedable", and "(o) p4 main text sheet feed sequence" is started (S4*a*18, S4*a*13, S4*a*14). That is, since the feeding is not performed when the "sheet presence or absence" of the preceding insert sheet p3 is unconfirmed, and the printer control portion 900 permits the feeding of the main text sheet after waiting the sheet presence/absence confirmation of the insert sheet, the printer control portion 900 performs the operation of confirming the presence or absence of an insert sheet.

<(k) p5 Insert Sheet Feed Sequence>

Receiving the sheet absence notification of the insert sheet p5 (S4*b*4), the printer control portion 900 finds another feeding tray as an automatic switching destination (S4*c*1), but in this example, an available feeding tray is not found, and the printer control portion 900 cancels "(k) p5 Insert Sheet Feed Sequence" and ends the print page sequence with sheet unfeedable (S4*b*9).

<(p) p6 Main Text Sheet Feed Sequence>

In this example, since finding the other feeding tray in the main text sheet feed determination (S4*a*1) (S4*a*12, S4*c*1') fails to find an available tray, the printer control portion 900 waits until the presence/absence of the insert sheet p5 of the immediately-before-sheet is confirmed (S4*c*2', S4*a*17). Since the "sheet absence" of the insert sheet p5 is confirmed with a timing of (12), it is determined that "Main text sheet is unfeedable", and the main text sheet feed sequence is ended (S4*a*18, S4*a*19, S4*a*2, S4*a*5). That is, in the case in which the printer control portion 900 waits the sheet presence/absence confirmation of the preceding insert sheet p5, and sheet absence is confirmed, the printer control portion 900 does not perform the feeding of the main text sheet, by which an inconsistency in a product can be prevented. However, in terms of a discharge interval between the insert sheet p3 and the main text sheet p5 (from (A) to (B) in FIG. 10A and FIG. 10B), the feeding interval is a discharge interval t3' longer than t3 because the printer control portion 900 waits the sheet presence/absence confirmation of the insert sheet p3, by which the productivity decreases.

As seen from the above, even when the remaining amount on a feeding tray of the inserter 3 is low or out, the operation without confirming the presence or absence of an insert sheet can be continued for the main text sheet as long as there is another automatically-switchable feeding tray with a high remaining amount, and thus the productivity can be improved. In addition, even in the case in which there is automatically-switchable feeding tray, when the remaining amount on the feeding tray is low or out, the feeding of the main text sheet is automatically switched to the operation of confirming the presence or absence of an insert sheet, and thus an inconsistency in a product can be prevented.

For example, in a job in which transfer sheets and insert sheets from the inserter are alternately fed, when a transfer sheet is fed following an insert sheet, the transfer sheet is fed without the confirmation of the sheet presence of an insert sheet when a high remaining amount of an insert sheet feeding portion is detected. Also in the case in which the remaining amount of insert sheets is low, when there is an insert sheet in another automatically-switchable insert sheet feeding portion, the transfer sheet is similarly fed without the confirmation of the sheet presence of an insert sheet. In a state in which the remaining amount of insert sheets is high, and there is no possibility that the insert sheets suddenly becomes absence, the productivity can be improved while a jam stop of a residual transfer sheet preceding an insert sheet and an inconsistency in a product due to the absence of an insert sheet can be prevented by performing the operation without confirming the presence or absence of an insert sheet.

In the present embodiment, the feeding of a main text sheet is switched to the operation of confirming the presence or absence of an insert sheet when the remaining amount of insert sheets on the feeding tray as an automatic switching destination is low. This switch is to prevent an inconsistency from occurring in a product due to a sudden absence of an insert sheet when the operation without confirming the presence or absence of an insert sheet is continued for a large number of insert sheets. However, the condition for switching to the operation of confirming the presence or absence of an insert sheet may be configured to include only whether a sheet on the feeding tray as an automatic switching destination is presence or absence by considering a case in which a detection accuracy of the remaining amount of insert sheets is high or by factoring in the length of a feeding interval between alternately fed main text sheets and insert sheets.

As described above, according to the present embodiment, the discharge of an incomplete product can be prevented while the productivity is kept even in the case in which the remaining amount of insert sheets on a specified insert sheet feed source becomes low.

Note that the configuration of the various kinds of data and the contents of the data described above is not limited to the above and may be formed of different configurations and contents according to applications or purposes. The embodiment is described above, but the present invention can include embodiments in the forms of, for example, systems, apparatuses, methods, programs, or recording media. Specifically, the present invention may be applied to a system formed of a plurality of apparatuses or may be applied to equipment formed of a single apparatus. In addition, configurations made by combining the above embodiments are to be included in the present invention.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-234093, filed Dec. 6, 2017, which is hereby incorporated by reference herein in its entirety.

What is claimed is:

1. An image forming apparatus, comprising:

a feeding unit configured to feed a sheet;

an image forming unit configured to form an image on the sheet fed from the feeding unit;

a plurality of stacking trays on which insert sheets to be inserted between sheets are stacked;

an insert unit configured to feed an insert sheet stacked on a stacking tray of the plurality of stacking trays as a feed source and to convey the insert sheet;

detection units configured to detect amounts of insert sheets stacked on the plurality of stacking trays, respectively; and a controller configured to start feeding of a sheet from the feeding unit without confirming a presence or absence of an insert sheet to be inserted before the sheet in a case in which an amount of insert sheets stacked on the stacking tray as the feed source is higher than a predetermined amount, wherein the insert unit switches the feed source from the stacking tray to another stacking tray of the plurality of stacking trays in a case in which the insert sheets stacked on the stacking tray as the feed source become absent, and wherein in a case in which the amount of the insert sheets stacked on the stacking tray as the feed source is lower than the predetermined amount, the controller starts feeding of a sheet from the feeding unit without confirming a presence or absence of an insert sheet to be inserted before the sheet when another stacking tray on which an amount of insert sheets is higher than the predetermined amount is present, and the controller starts the feeding of the sheet from the feeding unit after confirming the presence or absence of the insert sheet to be inserted before the sheet when the other stacking tray is absent.

2. The image forming apparatus according to claim 1, further comprising a setting unit configured to set a switching setting to be enabled or disabled, the switching setting being for switching the feed source from the stacking tray to the other stacking tray by the insert unit in the case in which the insert sheets stacked on the stacking tray as the feed source become absent, wherein in a case in which the switching setting is set to disabled, the insert unit does not switch the feed source from the stacking tray to the other stacking tray even in the case in which the insert sheets stacked on the stacking tray as the feed source become absent, and wherein in the case in which the switching setting is set to disabled, the controller starts feeding a sheet from the feeding unit after confirming the presence or absence of the insert sheet to be inserted before the sheet in the case in which the amount of the insert sheets stacked on the stacking tray as the feed source is lower than the predetermined amount.

3. The image forming apparatus according to claim 1, further comprising a setting unit configured to set types and sizes of the insert sheets stacked on the plurality of stacking trays, wherein in a case in which another stacking tray on which insert sheets of the same type and the same size as the insert sheets stacked on the stacking tray as the feed source is set are absent, the controller starts feeding a sheet from the feeding unit after confirming the presence or absence of the insert sheet to be inserted before the sheet in the case in which the amount of the insert sheets stacked on the stacking tray as the feed source is lower than the predetermined amount.

4. A control method for an image forming apparatus which includes a feeding unit configured to feed a sheet, an image forming unit configured to form an image on the sheet fed from the feeding unit, a plurality of stacking trays on which insert sheets to be inserted between sheets are stacked, an insert unit configured to feed an insert sheet using a stacking tray of the plurality of stacking trays as a feed source and to convey the insert sheet for merging downstream of the image forming unit, detection units configured to detect amounts of insert sheets stacked on the plurality of stacking trays, respectively, and a controller configured to start feeding of a sheet from the feeding unit without confirming a presence or absence of an insert sheet to be inserted before the sheet in a case in which an amount of insert sheets stacked on the stacking tray as the feed source is higher than a predetermined amount, wherein the insert unit switches the feed source from the stacking tray to another stacking tray in a case in which the insert sheets stacked on the stacking tray as the feed source become absent, the control method comprising:

determining, in a case in which the amount of the insert sheets stacked on the stacking tray as the feed source is lower than the predetermined amount, whether another stacking tray on which an amount of insert sheets is higher than the predetermined amount is present;

starting feeding a sheet from the feeding unit without confirming a presence or absence of an insert sheet to be inserted before the sheet when the other stacking tray is present; and starting feeding the sheet from the feeding unit after confirming the presence or absence of the insert sheet to be inserted before the sheet when the other stacking tray is absent.

5. A non-transitory computer-readable storage medium which stores a program which makes a computer execute the control method as recited in claim 4.

* * * * *